US011004420B2

(12) United States Patent
Uchiyama

(10) Patent No.: US 11,004,420 B2
(45) Date of Patent: May 11, 2021

(54) SIGNAL PROCESSING DEVICE, SIGNAL PROCESSING METHOD, AND LIQUID CRYSTAL DISPLAY DEVICE

(71) Applicant: JVCKENWOOD Corporation, Yokohama (JP)

(72) Inventor: Yuji Uchiyama, Yokohama (JP)

(73) Assignee: JVCKENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/844,008

(22) Filed: Apr. 9, 2020

(65) Prior Publication Data

US 2020/0327859 A1 Oct. 15, 2020

(30) Foreign Application Priority Data

Apr. 10, 2019 (JP) ..... JP2019-074561
Apr. 1, 2020 (JP) ..... JP2020-065507

(51) Int. Cl.
*G09G 3/20* (2006.01)
*G09G 3/36* (2006.01)

(52) U.S. Cl.
CPC ... *G09G 3/3696* (2013.01); *G09G 2310/0259* (2013.01); *G09G 2310/066* (2013.01); *G09G 2310/08* (2013.01); *G09G 2320/0271* (2013.01)

(58) Field of Classification Search
CPC .. G09G 3/2096; G09G 3/3696; G09G 3/3688; G09G 2300/0828; G09G 2310/027; G09G 2310/0259; G09G 2310/0294; G09G 2310/066; G09G 2310/08; G09G 2320/0233; G09G 2320/0271; G09G 2360/12; G09G 2360/128
See application file for complete search history.

(56) References Cited

U.S. PATENT DOCUMENTS

2002/0036715 A1* 3/2002 Honda ..... H04N 7/0122 348/672
2011/0279723 A1* 11/2011 Takamiya ..... H04N 5/3745 348/308

(Continued)

FOREIGN PATENT DOCUMENTS

JP j06178238 A 6/1994

*Primary Examiner* — Michael J Eurice
(74) *Attorney, Agent, or Firm* — Nath, Goldberg and Meyer; Jerald L. Meyer

(57) ABSTRACT

A display gradation number acquisition unit acquires the number of display gradations of the video data during each horizontal scanning period based on a gradation histogram. A first display gradation holding period value generator generates a first display gradation holding period value based on a gradation value difference. A second display gradation holding period value generator generates a second display gradation holding period value based on the number of pixels for each display gradation. A holding period provisional value generator selects a display gradation holding period value having a larger value to generate a holding period provisional value. A holding period total value generator generates a holding period total value that is a sum of the holding period provisional value during each horizontal scanning period. A holding period optimum value generator generates a holding period optimum value of each display gradation.

4 Claims, 36 Drawing Sheets

(56) References Cited

U.S. PATENT DOCUMENTS

| | | | | |
|---|---|---|---|---|
| 2013/0120350 | A1* | 5/2013 | Ichimasa | G09G 3/3648 345/212 |
| 2016/0189643 | A1* | 6/2016 | Uchiyama | G09G 3/3607 345/690 |

* cited by examiner

SIGNAL PROCESSING DEVICE, SIGNAL PROCESSING METHOD, AND LIQUID CRYSTAL DISPLAY DEVICE

CROSS REFERENCE TO RELATED APPLICATION

This application is based upon and claims the benefit of priority under 35 U.S.C. § 119 from Japanese Patent Application No. 2019-074561 filed on Apr. 10, 2019, and Japanese Patent Application No. 2020-065507 filed on Apr. 1, 2020, the entire contents of both of which are incorporated herein by reference.

BACKGROUND

The present disclosure relates to a signal processing device, a signal processing method, and a liquid crystal display device that process video data input to a liquid crystal device.

A liquid crystal display device includes a liquid crystal device and a signal processing device that processes video data to be input to the liquid crystal device. The signal processing device generates gradation-corrected video data by correcting a gradation of the video data, and outputs the same to the liquid crystal device. The liquid crystal device has a pixel region in which a plurality of pixels is arranged. The liquid crystal display device displays a gradation image by driving the liquid crystal device based on the gradation data of each pixel.

Japanese Unexamined Patent Application Publication No. 6-178238 (Patent Document 1) teaches to compare the gradation data of each pixel for one horizontal line with an output of a counter, and to perform sampling of an analog ramp waveform at the timing when both coincide. An analog voltage of the sampled analog ramp waveform is supplied to the pixels thereby displaying the gradation image.

SUMMARY

In the liquid crystal display device described in Patent Document 1, the analog ramp waveform is sampled by comparing the gradation data of the pixel with the output of the counter within one horizontal scanning period. Therefore, when there are many pixels with the same gradation in the horizontal direction, more analog switches are turned off at the sampling timing of the gradation.

However, if many analog switches are turned off simultaneously, large load fluctuations may occur for the analog ramp waveform. As a result, large ringing occurs in the analog ramp waveform at this timing. The occurrence of ringing in the analog ramp waveform deteriorates the reproducibility of the gradation in the vicinity.

A first aspect of one or more embodiments provides a signal processing device including: a gradation histogram generator configured to generate a gradation histogram indicating the number of pixels for each display gradation of input video data during each horizontal scanning period; a display gradation number acquisition unit configured to acquire the number of display gradations of the video data during each horizontal scanning period based on the gradation histogram; a first display gradation holding period value generator configured to generate a first display gradation holding period value based on a gradation value difference, the first display gradation holding period value being a display gradation holding period value indicating a period for holding a display gradation determined based on the gradation value difference between two adjacent display gradations in each horizontal scanning period and a voltage slew rate of a ramp waveform signal; a second display gradation holding period value generator configured to generate a second display gradation holding period value based on the number of pixels for each display gradation, the second display gradation holding period value being a display gradation holding period value indicating a period for holding a display gradation based on a settling period in which ringing of the ramp waveform signal generated at a timing when a voltage value of the ramp waveform signal changes according to the number of display gradations attenuates to a level that does not affect a displayed image by the input video data; a holding period provisional value generator configured to compare the first display gradation holding period value and the second display gradation holding period value, and to select a display gradation holding period value having a larger value between the first display gradation holding period value and the second display gradation holding period value to generate a holding period provisional value; a holding period total value generator configured to generate a holding period total value that is a sum of the holding period provisional value during each horizontal scanning period; a holding period optimum value generator configured to generate a holding period optimum value of each display gradation, based on a display target gradation number, which is the number of gradations to be displayed during each horizontal scanning period, and the holding period provisional value; a ramp waveform signal data generator configured to generate ramp waveform signal data that holds gradation data for generating the ramp waveform signal based on the holding period optimum value.

A second aspect of one or more embodiments provides a liquid crystal display device including the above-described signal processing device further including a display gradation converting data generator configured to correct a gradation of the video data for each horizontal scanning period based on the holding period optimum value, and to generate gradation-corrected video data, a ramp waveform signal generating circuit configured to analog convert the ramp waveform signal data to generate the ramp waveform signal; and a liquid crystal device having a plurality of pixels and configured to generate a gradation drive voltage for each of the pixels based on the gradation-corrected video data and the ramp waveform signal.

A third aspect of one or more embodiments provides a signal processing method including: generating a gradation histogram indicating the number of pixels for each display gradation of input video data during each horizontal scanning period; acquiring the number of display gradations of the video data during each horizontal scanning period based on the gradation histogram; generating a first display gradation holding period value based on a gradation value difference, the first display gradation holding period value being a display gradation holding period value indicating a period for holding a display gradation determined based on the gradation value difference between two adjacent display gradations in each horizontal scanning period and a voltage slew rate of a ramp waveform signal; generating a second display gradation holding period value based on the number of pixels for each display gradation, the second display gradation holding period value being a display gradation holding period value indicating a period for holding a display gradation based on a settling period in which ringing of the ramp waveform signal generated at a timing when a voltage value of the ramp waveform signal changes according to the number of display gradations attenuates to a level that does not affect a displayed image by the input video data; comparing the first display gradation holding period value and the second display gradation holding period value; selecting a display gradation holding period value having a larger value between the first display gradation holding period value and the second display gradation holding period value to generate a holding period provisional value; generating a holding period total value that is a sum of the holding period provisional value during each horizontal scanning period; generating a holding period optimum value of each display gradation, based on a display target gradation number, which is the number of gradations to be displayed during each horizontal scanning period, and the holding period provisional value; generating ramp waveform signal data that holds gradation data for generating the ramp waveform signal based on the holding period optimum value.

DETAILED DESCRIPTION

Figure 1:
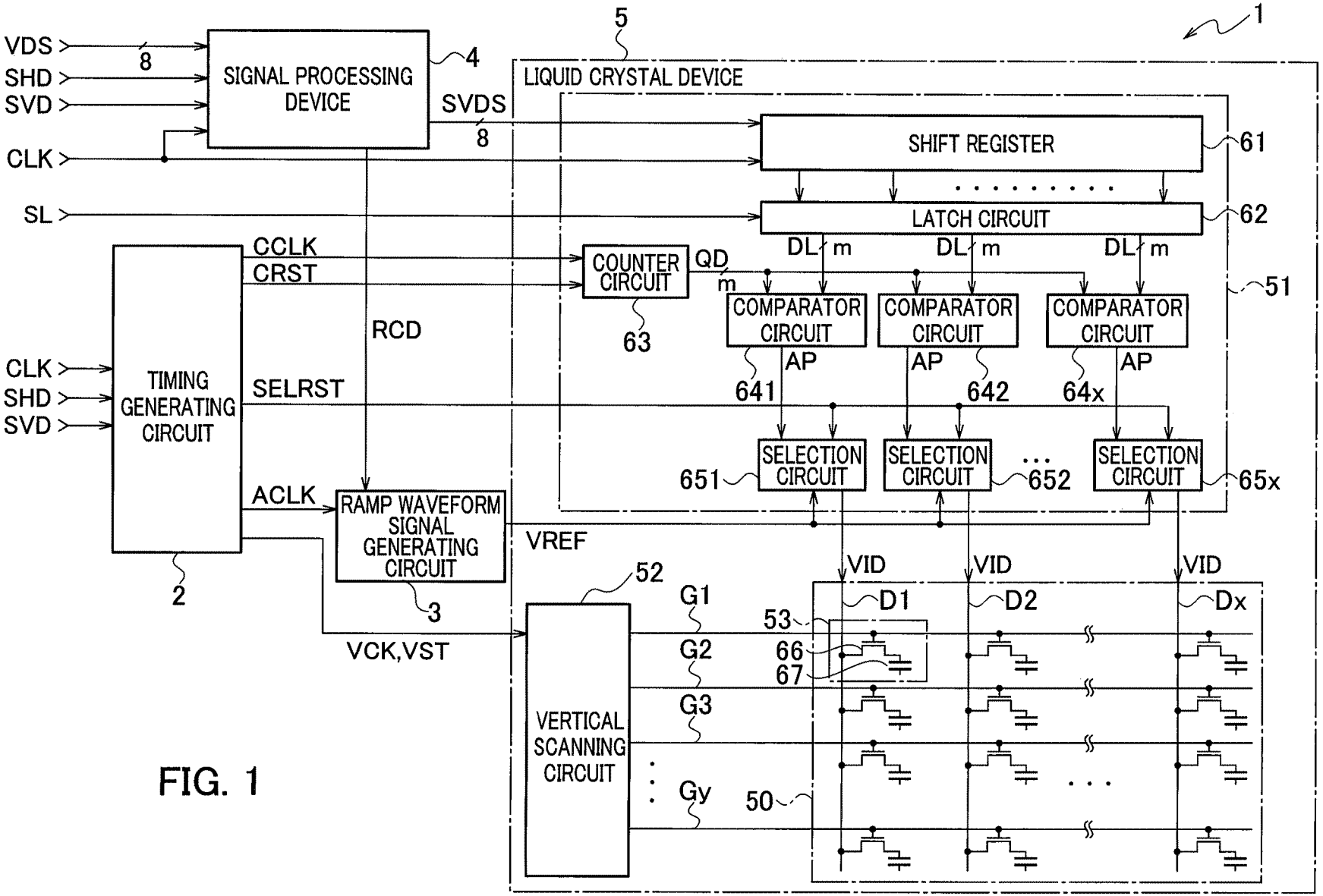
FIG. 1 is a configuration diagram illustrating an example of a liquid crystal display device according to one or more embodiments.

A configuration example of a liquid crystal display device according to one or more embodiments is described by referring to FIG. 1. The liquid crystal display device 1 includes a timing generating circuit 2, a ramp waveform signal generating circuit 3, a signal processing device 4, and a liquid crystal device 5. The liquid crystal device 5 includes a display pixel unit 50, a horizontal scanning circuit 51, and a vertical scanning circuit 52. The display pixel unit 50 includes a plurality (x) of column data lines D (D1 to Dx) arranged in a horizontal direction and a plurality (y) of row scanning lines G (G1 to Gy) arranged in a vertical direction, thus, (x×y) pixels 53 arranged in a matrix form at each intersection thereof.

Figure 2:
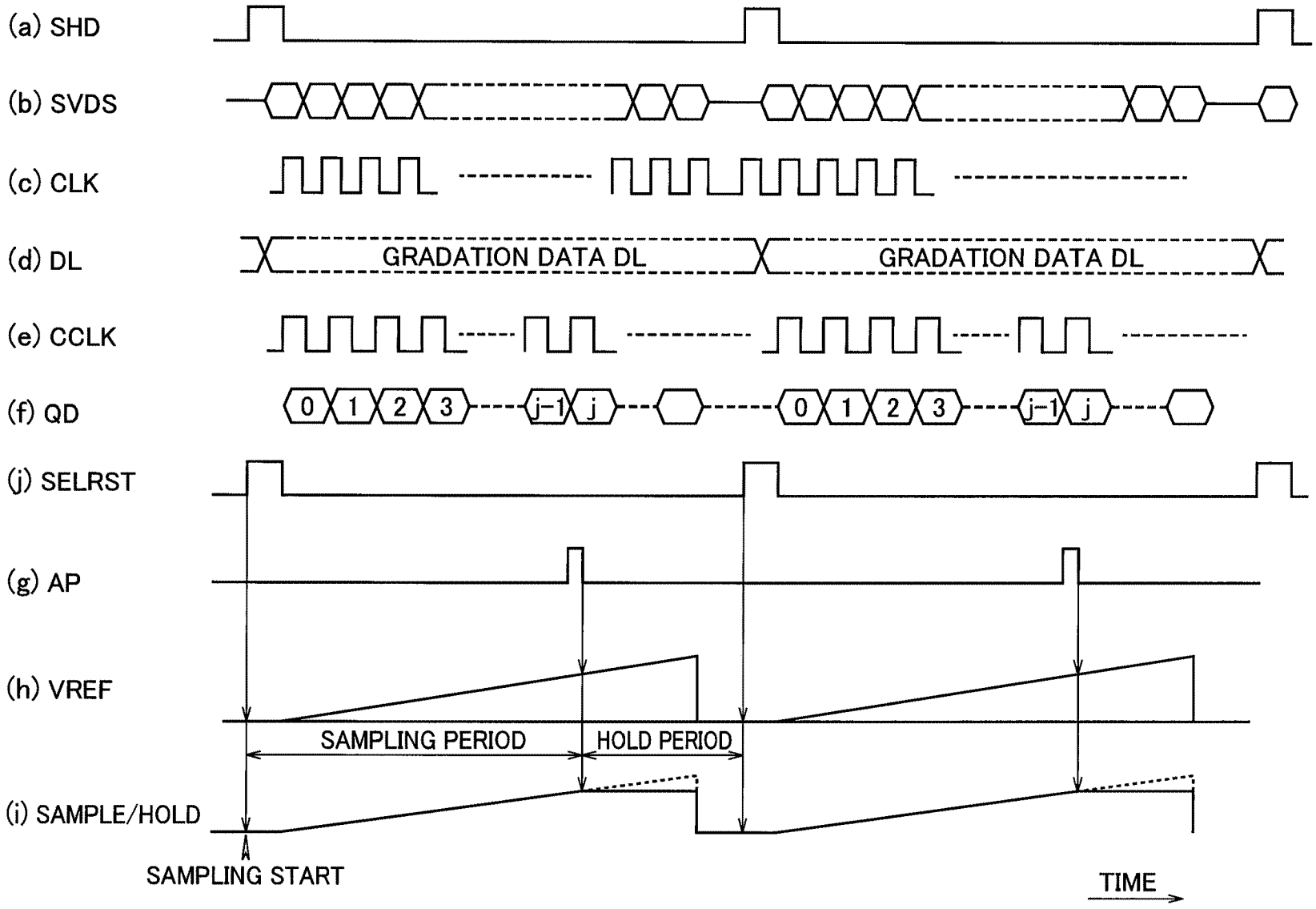
FIG. 2 is a time chart showing examples of various signals in the liquid crystal display device.

FIG. 2 shows an example of a relationship of various signals in the liquid crystal display device 1 in the form of a time chart. In FIG. 2, (a) denotes a horizontal synchronization signal SHD, (b) denotes gradation-corrected video data SVDS, (c) denotes a clock signal CLK, (d) denotes gradation data DL, and (e) denotes a counter clock signal CCLK. (f) denotes a gradation counter value QD, (j) denotes an all-pixel reset signal SELRST, (g) denotes a coincidence pulse signal AP, (h) denotes a ramp waveform signal VREF, and (i) denotes a sampling period and a hold period.

The signal processing device 4 receives video data VDS that is a digital signal, and the horizontal synchronization signal SHD and the clock signal CLK that are synchronized with the video data VDS. The signal processing device 4 may further receive a vertical synchronization signal SVD.

The signal processing device 4 generates the gradation-corrected video data SVDS, in which the video data VDS is corrected in the horizontal direction based on the horizontal synchronization signal SHD and the clock signal CLK, and outputs the same to the horizontal scanning circuit 51 of the liquid crystal device 5. Based on the horizontal synchronization signal SHD, the vertical synchronization signal SVD, and clock signal CLK, the signal processing device 4 may generate the gradation-corrected video data SVDS, in which the video data VDS is gradation-corrected in the horizontal direction and the vertical direction, and output the same to the horizontal scanning circuit 51.

The gradation-corrected video data SVDS is generated by performing gradation correction on the video data VDS per horizontal scanning period. When there are many pixels having the same gradation in the horizontal direction, a sampling timing for the gradation can be shifted per pixel 53 by correcting the gradation of the video data VDS per horizontal scanning period.

Based on the video data VDS, the horizontal synchronization signal SHD, and the clock signal CLK, the signal processing device 4 generates ramp waveform control data RCD for holding the gradation data, and outputs the same to the ramp waveform signal generating circuit 3. A specific configuration example of and a signal processing method employed by the signal processing device 4 will be described later.

The timing generating circuit 2 receives the clock signal CLK, the horizontal synchronization signal SHD, and the vertical synchronization signal SVD. Based on the clock signal CLK and the horizontal synchronization signal SHD, the timing generating circuit 2 generates the counter clock signal CCLK, a counter reset signal CRST, and the all-pixel reset signal SELRST, and outputs them to the horizontal scanning circuit 51.

The timing generating circuit 2 outputs a gradation counter clock signal ACLK to the ramp waveform signal generating circuit 3. Based on the clock signal CLK, the horizontal synchronization signal SHD, and the vertical synchronization signal SVD, the timing generating circuit 2 generates a row selection signal VCK and a vertical reset signal VST, and outputs them to the vertical scanning circuit 52.

The ramp waveform signal generating circuit 3 generates the ramp waveform signal VREF (analog ramp waveform signal) based on the gradation counter clock signal ACLK, and outputs the same to the horizontal scanning circuit 51. The ramp waveform signal VREF is constituted by an analog ramp waveform of a periodic sweep signal that changes in a direction in which the voltage increases from a black display voltage level to a white display voltage level in the pixel 53 in a cycle of one horizontal scanning period.

The horizontal scanning circuit 51 is connected to the pixels 53 of the display pixel unit 50 via the column data lines D1 to Dx. For example, the column data line D1 is connected to the y pixels 53 in the first column of the display pixel unit 50. The column data line D2 is connected to the y pixels 53 in the second column of the display pixel unit 50, and the column data line Dx is connected to the y pixels 53 in the x-th column of the display pixel unit 50.

The horizontal scanning circuit 51 includes a shift register 61, a latch circuit 62, a counter circuit 63, x comparator circuits 64 (641 to 64*x*), and x selection circuits 65 (651 to 65*x*).

The shift register 61 receives the gradation-corrected video data SVDS and the clock signal CLK. Based on the clock signal CLK the shift register 61 sequentially receives the gradation-corrected video data SVDS as the gradation data DL corresponding to the x pixels 53 of one row scanning line G in units of 1 horizontal scanning period.

The gradation data DL includes n-bit gradation data. For example, when n=12 bits, a gradation display can be made with 4096 (2n) gradations for each pixel 53. The shift register 61 sequentially receives and shifts n-bit gradation data in parallel. For example, when the display pixel unit 50 is full high-definition compatible, that is, when x=1920, the shift register 61 receives and shifts n-bit gradation data corresponding to each of 1920 pixels 53 in one horizontal scanning period.

A latch pulse signal SL is input to the latch circuit 62 within one horizontal blanking period. Based on the latch pulse signal SL, the latch circuit 62 takes in the gradation data DL corresponding to the x pixels 53 of one row scanning line G from the shift register 61 in one horizontal scanning period. The latch circuit 62 holds, for the next one horizontal scanning period, the taken in n-bit gradation data corresponding to each of the x pixels 53.

The counter circuit 63 receives the counter clock signal CCLK and the counter reset signal CRST from the timing generating circuit 2. The counter circuit 63 sequentially counts up the n-bit gradation counter value QD based on the counter clock signal CCLK. As a result, the counter circuit 63 outputs 2n gradation counter values QD (0 to (2n−1)) to the comparator circuits 64 (641 to 64*x*) per horizontal scanning period. Accordingly, the counter circuit 63 outputs to each comparator circuit 64 the gradation counter value QD having the same number of gradations as the gradation data.

One comparator circuit 64 (641 to 64*x*) corresponds to one column data line D (D1 to Dx). Each comparator circuit 64 receives the gradation counter value QD from the counter circuit 63, and receives the gradation data DL corresponding to each pixel 53 from the latch circuit 62. The comparator circuit 64 compares the gradation data DL and the gradation counter value QD on a bit-by-bit basis, generates the coincidence pulse signal AP when both match, and outputs the coincidence pulse signal AP to the corresponding selection circuit 65.

One selection circuit 65 (651 to 65*x*) corresponds to one comparator circuit 64 (641 to 64*x*). One selection circuit 65 (651 to 65*x*) is connected to each column data line D (D1 to Dx). For example, the selection circuit 651 is connected to the y pixels 53 in the first column of the display pixel unit 50 via the column data line D1. The selection circuit 652 is connected to the y pixels 53 in the second column of the display pixel unit 50 via the column data line D2. Similarly, the selection circuit 65*x* is connected to the y pixels 53 in the x-th column of the display pixel unit 50 via the column data line Dx.

Each selection circuit 65 receives the coincidence pulse signal AP from the corresponding comparator circuit 64. Further, each selection circuit 65 receives the ramp waveform signal VREF from the ramp waveform signal generating circuit 3 and the all-pixel reset signal SELRST from the timing generating circuit 2.

The selection circuit 65 includes an analog switch for starting and stopping the sampling. In each selection circuit 65, when the all-pixel reset signal SELRST is input from the timing generating circuit 2 during one horizontal blanking period, the analog switch thereof is turned on and sampling of the ramp waveform signal VREF is started. In each selection circuit 65, the analog switch thereof is turned off at the rising timing of the coincidence pulse signal AP, and the sampling is stopped.

The selection circuit 65, in the units of one horizontal scanning period, within the period from the input of the all-pixel reset signal SELRST to the rising of the coincidence pulse signal AP, outputs the sampled ramp waveform signal VREF to the corresponding column data line D as a gradation drive voltage VID that is an analog voltage. The selection circuit 65 determines the gradation drive voltage VID to be output to the column data line D1 by turning off the sampling at the rising timing of the coincidence pulse signal AP. For example, the selection circuit 651 outputs the ramp waveform signal VREF sampled at the rising timing of the coincidence pulse signal AP output from the comparator circuit 641 to the column data line D1 as the gradation drive voltage VID.

The vertical scanning circuit 52 is connected to the pixels 53 of the display pixel unit 50 via the row scanning lines G (G1 to Gy). For example, the row scanning line G1 is connected to the x pixels 53 in the first row of the display pixel unit 50. The row scanning line G2 is connected to the x pixels 53 in the second row of the display pixel unit 50. Similarly, the row scanning line Gy is connected to the x pixels 53 in the y-th row of the display pixel unit 50.

The row selection signal VCK and the vertical reset signal VST are input from the timing generating circuit 2 to the vertical scanning circuit 52. The vertical scanning circuit 52 sequentially outputs the row selection signal VCK for sequentially selecting the row scanning lines G (G1 to Gy) one by one in the units of one horizontal scanning period from the row scanning line G1 to the row scanning line Gy.

Each pixel 53 of the display pixel unit 50 includes a pixel selection transistor 66 and a liquid crystal driving unit 67. The pixel selection transistor 66 has a gate connected to the row scanning line G, a drain connected to the column data line D, and a source connected to the liquid crystal driving unit 67. A thin film transistor may be used as the pixel selection transistor 66.

Each pixel selection transistor 66 is subjected to switching control based on the row selection signal VCK input from the vertical scanning circuit 52 via the row scanning line G. The pixel selection transistor 66 is turned on based on the row selection signal VCK, whereby the gradation drive voltage VID is applied to the liquid crystal driving unit 67.

The liquid crystal driving unit 67 is driven based on the gradation drive voltage VID. With this, each pixel 53 is displayed in the gradation according to the voltage value of the applied gradation drive voltage VID. By displaying all the pixels 53 of the display pixel unit 50 with respective gradations, an image of one frame can be displayed in gradation.

Figure 3:
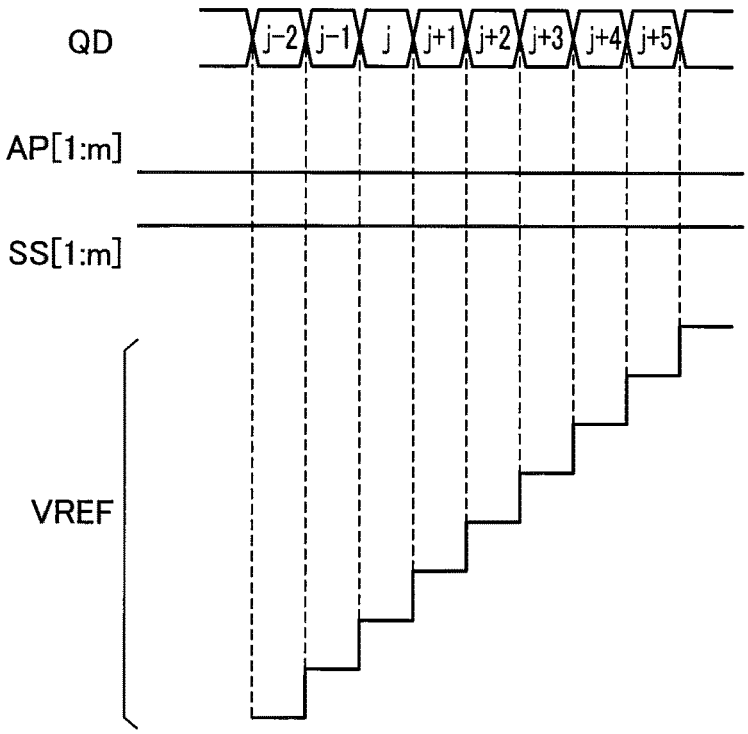
FIG. 3 is a schematic diagram for explaining a case in which a gradation correction is not performed on video data in a horizontal direction.
Figure 4:
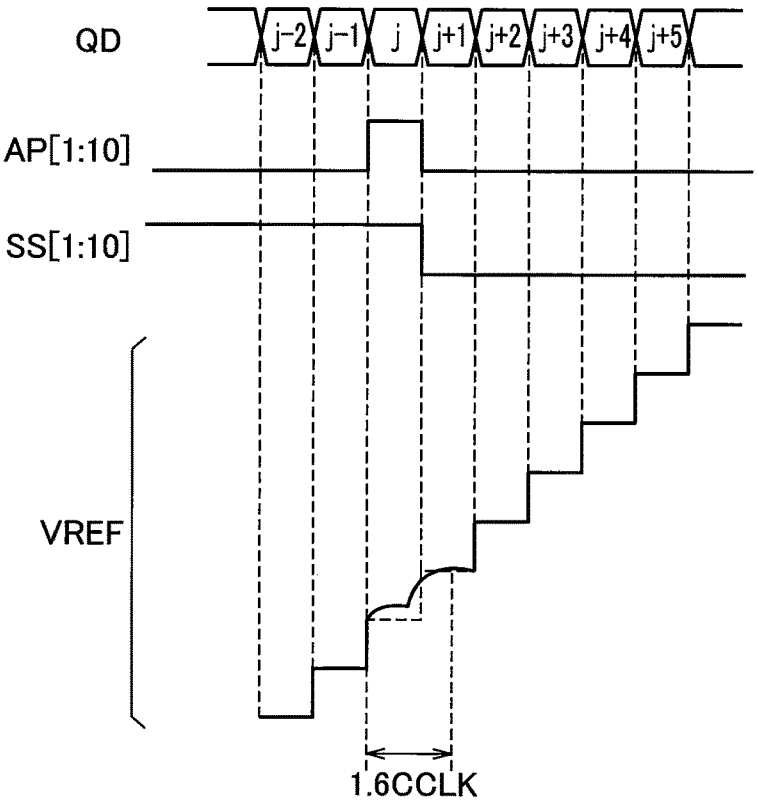
FIG. 4 is a schematic diagram for explaining a case in which a gradation correction is not performed on video data in a horizontal direction.
Figure 5:
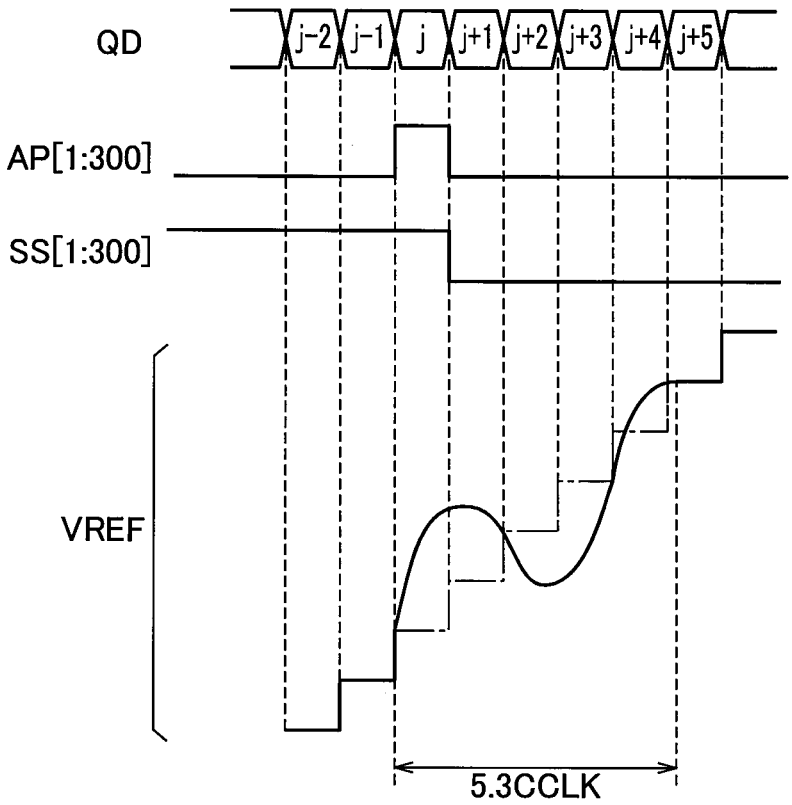
FIG. 5 is a schematic diagram for explaining a case in which a gradation correction is not performed on video data in a horizontal direction.

By using FIGS. 3 to 5, a case where the video data VDS is not subjected by the signal processing device 4 to a gradation correction in the horizontal direction will be described as a comparative example. In FIGS. 3 to 5, a symbol SS indicates a switching signal output from the analog switch of the selection circuit 65.

FIG. 3 shows a case where, among the x pixels 53 in the horizontal direction, the number of pixels 53 in which the gradation counter value QD is in the range of j−2 to j+5 is zero. FIG. 4 shows a case in which, among the x pixels 53 in the horizontal direction, the gradation counter value QD of the 10-th pixel 53 is j, and the gradation counter values QD of the other pixels 53 are not in the range of j−2 to j+5. FIG. 5 shows a case in which, among the x pixels 53 in the horizontal direction, the gradation counter value QD of the 1-st to 100-th pixels 53 is j, and the gradation counter values QD the other pixels 53 are not in the range of j−2 to j+5.

As shown in FIG. 3, when the number of the pixels 53 in which the gradation counter value QD is in the range of j−2 to j+5 is 0, for the gradation counter value QD in the range of j−2 to j+5, the coincidence pulse signal AP is not input from the comparator circuit 64 (641 to 64*x*) to the selection circuit 65 (651 to 65*x*). Accordingly, for the gradation counter value QD in the range of j−2 to j+5, because the number of the analog counters that can be switched from the on state to the off state is also zero, the ramp waveform signal VREF is not affected by load fluctuations that occur when the analog switch is switched off.

As shown in FIG. 4, for the gradation counter value QD in the range of j−2 to j+5, when the number of pixels 53 having the same gradation (QD=j) is small, the number of coincidence pulse signals AP that are output from the comparator circuit 64 (641 to 64*x*) to the selection circuit 65 (651 to 65*x*) is also small (10). Accordingly, since there are few (10) analog switches that are switched from the on state to the off state, the ramp waveform signal VREF is less affected by load fluctuations that occur when the analog switch is switched to the off state. Therefore, the ringing generated in the analog ramp waveform of the ramp waveform signal VREF has a level of one gradation or less, and the reproducibility of the gradation counter value QD is not deteriorated even in the 1.6 settling period in which the ringing occurs.

As shown in FIG. 5, for the gradation counter value QD in the range of j−2 to j+5, when the number of pixels 53 having the same gradation (QD=j) is large (300), the number of coincidence pulse signals AP that are output from the comparator circuit 64 (641 to 64*x*) to the selection circuit 65 (651 to 65*x*) is also large (300). Accordingly, since there are many (300) analog switches that can be switched from the on state to the off state, the ramp waveform signal VREF is also greatly affected by load fluctuations that occur when the analog switch is switched to the off state. Therefore, the ringing generated in the analog ramp waveform of the ramp waveform signal VREF is of the level of one gradation or more, and the reproducibility of the gradation QD deteriorates in the 5.3 settling period in which the ringing occurs.

Figure 6:
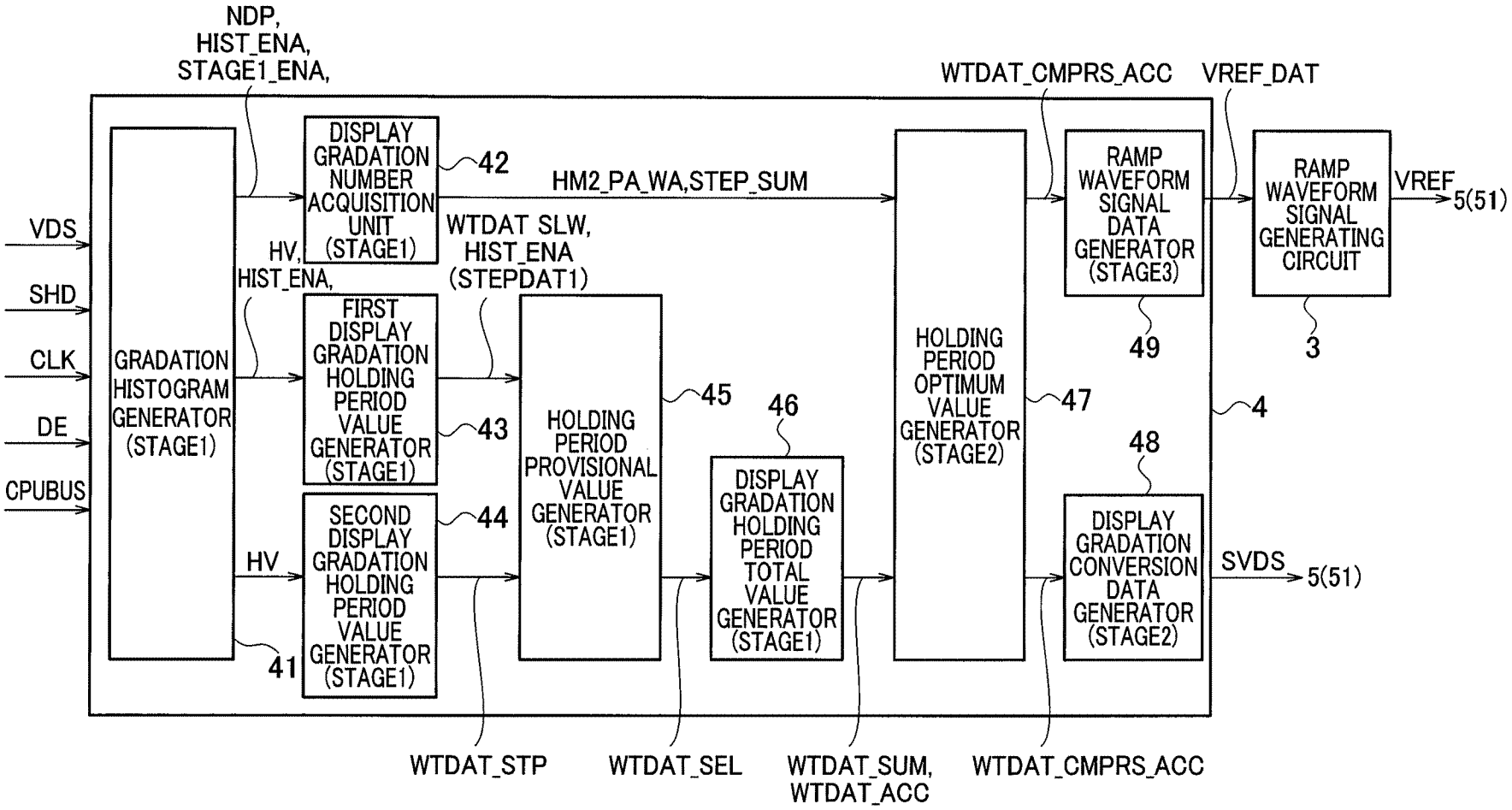
FIG. 6 is a configuration diagram illustrating an example of a signal processing device according to one or more embodiments.

A configuration example of the signal processing device 4 according to one or more embodiments will be described by using FIG. 6. The signal processing device 4 includes a gradation histogram generator 41, a display gradation number acquisition unit 42, a first display gradation holding period value generator 43, and a second display gradation holding period value generator 44. Furthermore, the signal processing device 4 includes a holding period provisional value generator 45, a holding period total value generator 46, a holding period optimum value generator 47, a display gradation conversion data generator 48, and a ramp waveform signal data generator 49. The processing in the gradation histogram generator 41 to the holding period total value generator 46 is referred to as a processing in STAGE 1. The processing in the holding period optimum value generator 47 and the display gradation conversion data generator 48 is referred to as a processing in STAGE 2. The processing in the ramp waveform signal data generator 49 is referred to as a processing in stage 3.

Figure 7A:
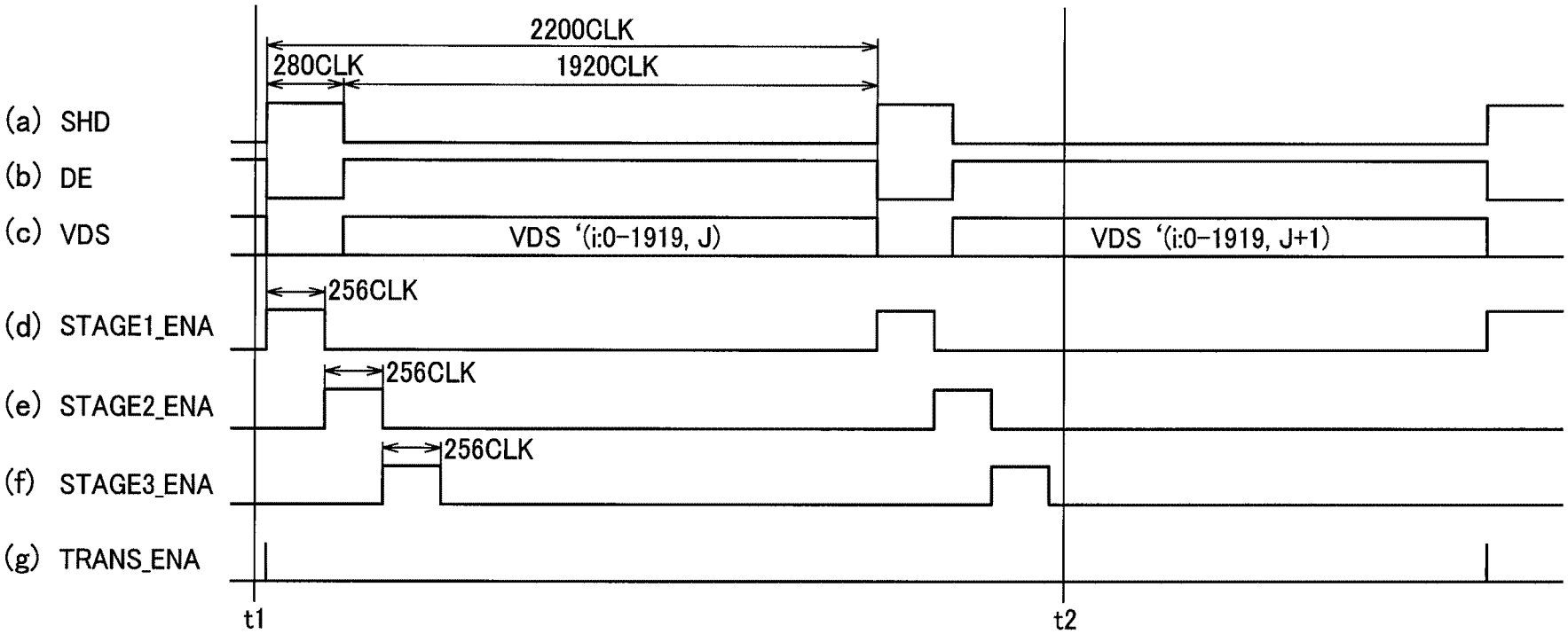
FIG. 7A is a time chart showing a first example of various signals in the signal processing device.
Figure 7B:
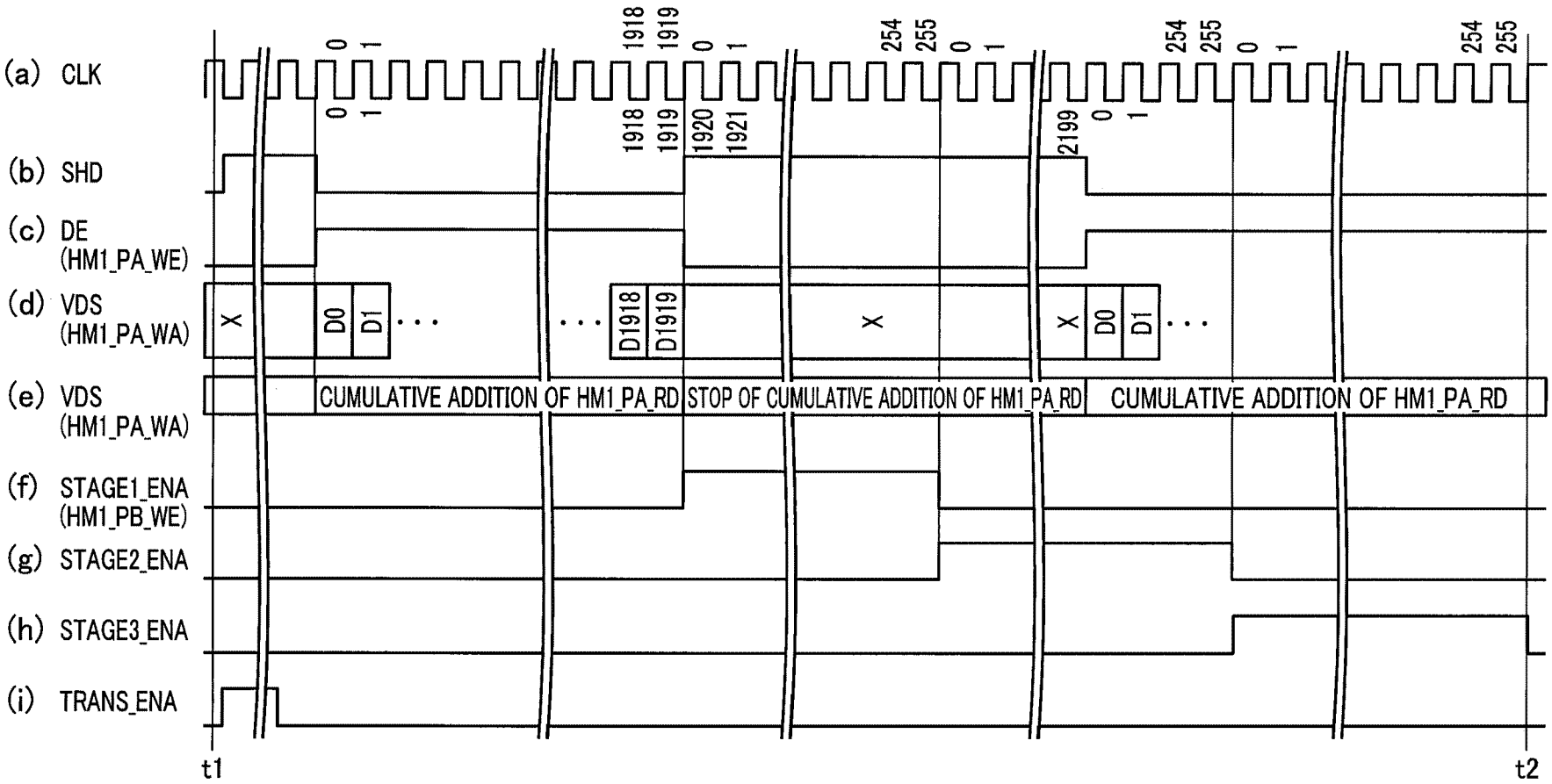
FIG. 7B is a time chart showing a second example of various signals in the signal processing device.

FIGS. 7A and 7B show an example of the relationship between the various signals in the signal processing device 4 in the form of the time charts. In FIG. 7A, (a) to (g) denote the horizontal synchronization signal SHD, a data enable signal DE, the video data VDS, an enable signal STAGE1_ENA, an enable signal STAGE2_ENA, an enable signal STAGE3_ENA, and a timing signal TRANS_ENA, respectively. The timing signal TRANS_ENA is a timing signal for instructing the timing of batch transfer of the video data VDS.

In FIG. 7B, (a) to (i) denote the clock signal CLK, the horizontal synchronization signal SHD, the data enable signal DE, the video data VDS, the enable signal STAGE1_ENA, the enable signal STAGE2_ENA, the enable signal STAGE3_ENA, and the timing signal TRANS_ENA, respectively. (c) to (i) of FIG. 7B show that a gradation histogram value to be described later is generated and written to the A port PA of a memory 413.

The video data VDS, the horizontal synchronization signal SHD, the clock signal CLK, and a data enable signal DE that is a control input signal are input to the gradation histogram generator 41. The gradation histogram generator 41 generates a display target gradation histogram NDP, which represents the number of display pixels for each display gradation of the video data VDS input during one horizontal scanning period, and outputs the same to the display gradation number acquisition unit 42. Hereinafter, the display target gradation histogram NDP is simply referred to as a gradation histogram NDP.

Figure 8:
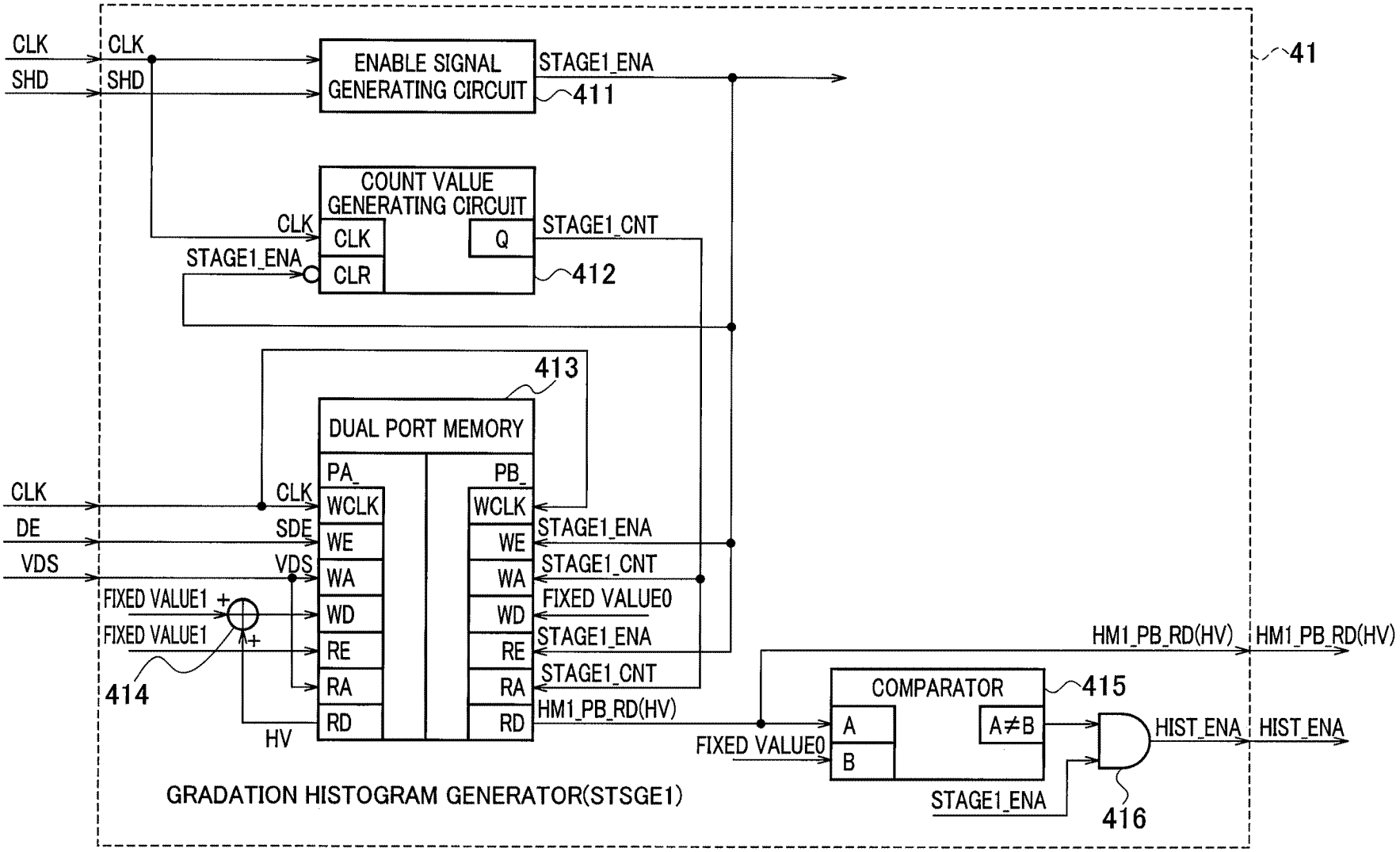
FIG. 8 is a configuration diagram illustrating an example of a gradation histogram generator.
Figure 9A:
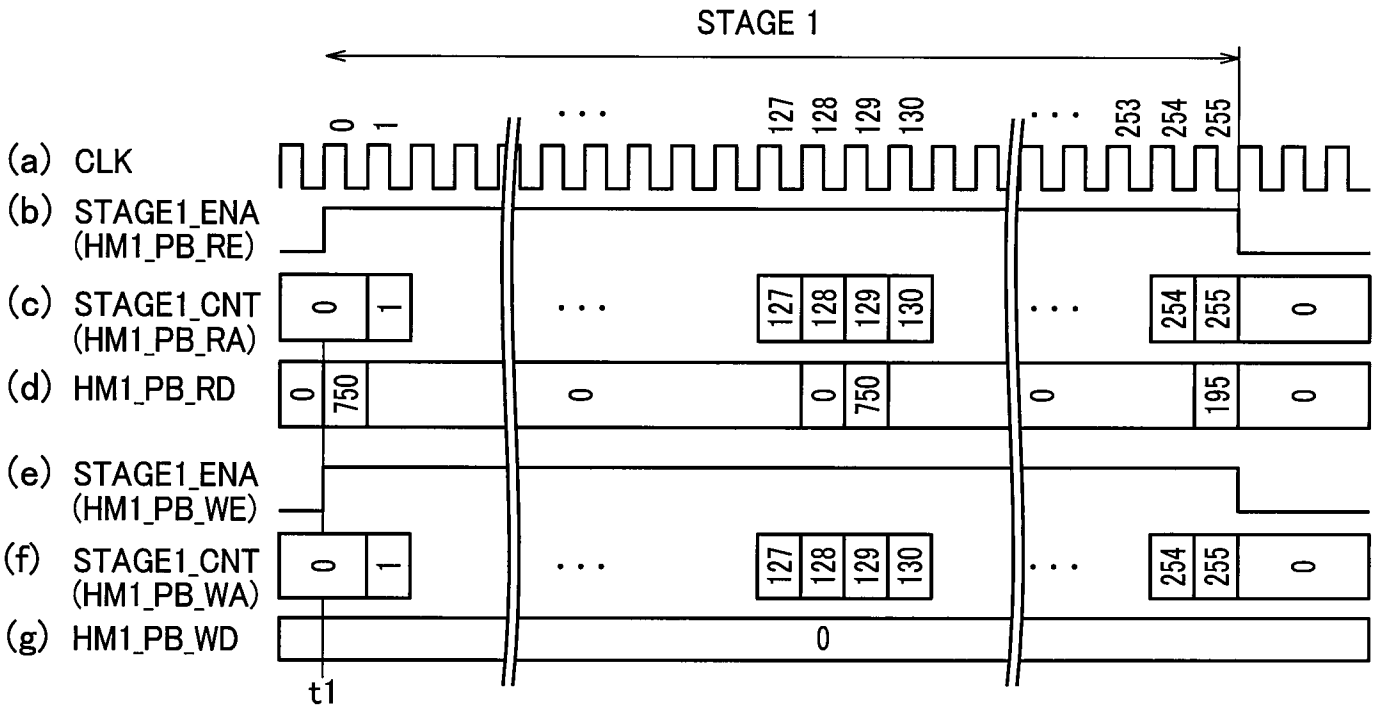
FIG. 9A is a time chart showing a first example of various signals in the gradation histogram generator, a display gradation number acquisition unit, a first display gradation holding period value generator, a second display gradation holding period value generator, a holding period provisional value generator, and a holding period total value generator.
Figure 9B:
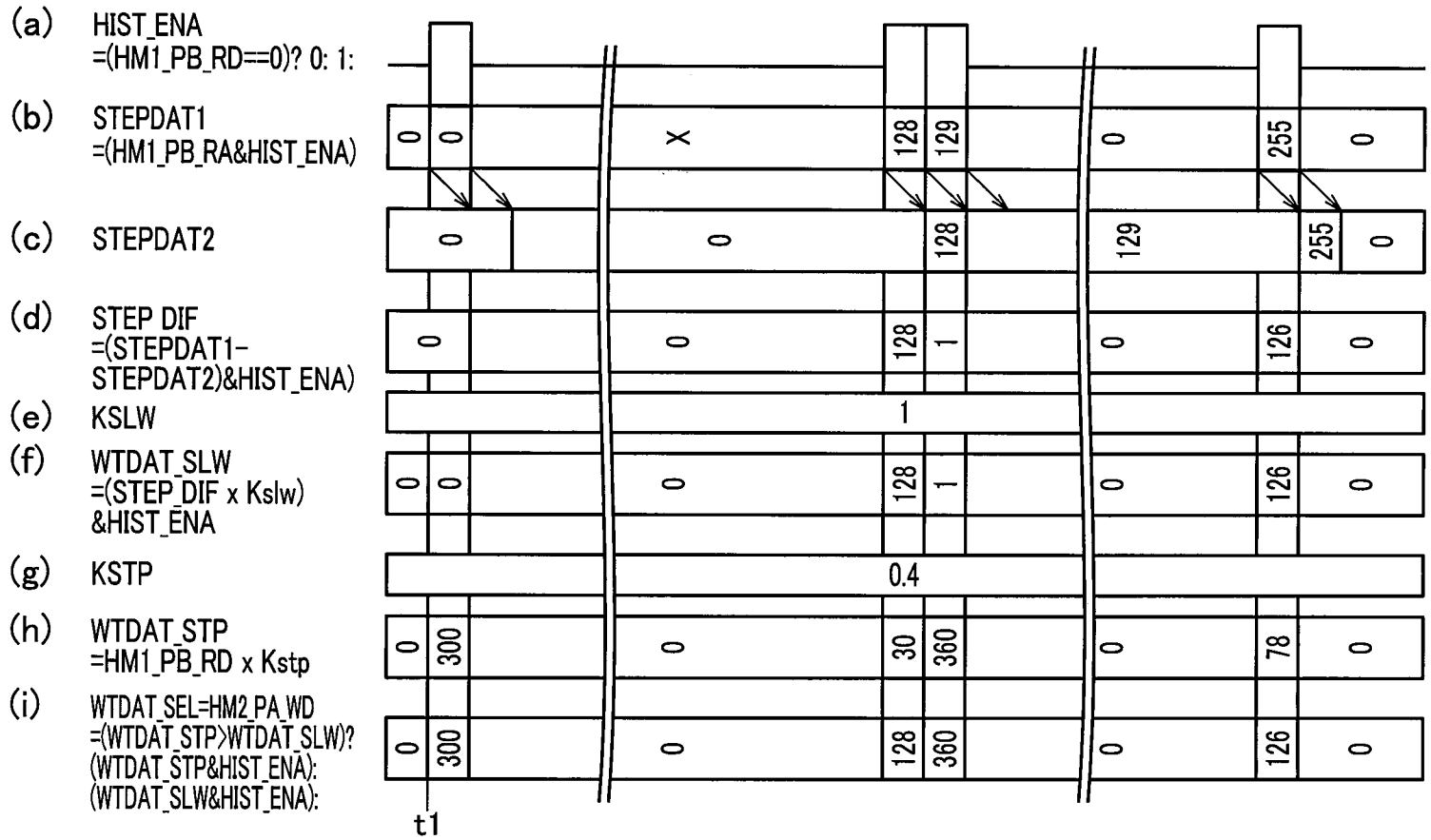
FIG. 9B is a time chart showing a second example of various signals in the gradation histogram generator, the display gradation number acquisition unit, the first display gradation holding period value generator, the second display gradation holding period value generator, the holding period provisional value generator, and the holding period total value generator.
Figure 9C:
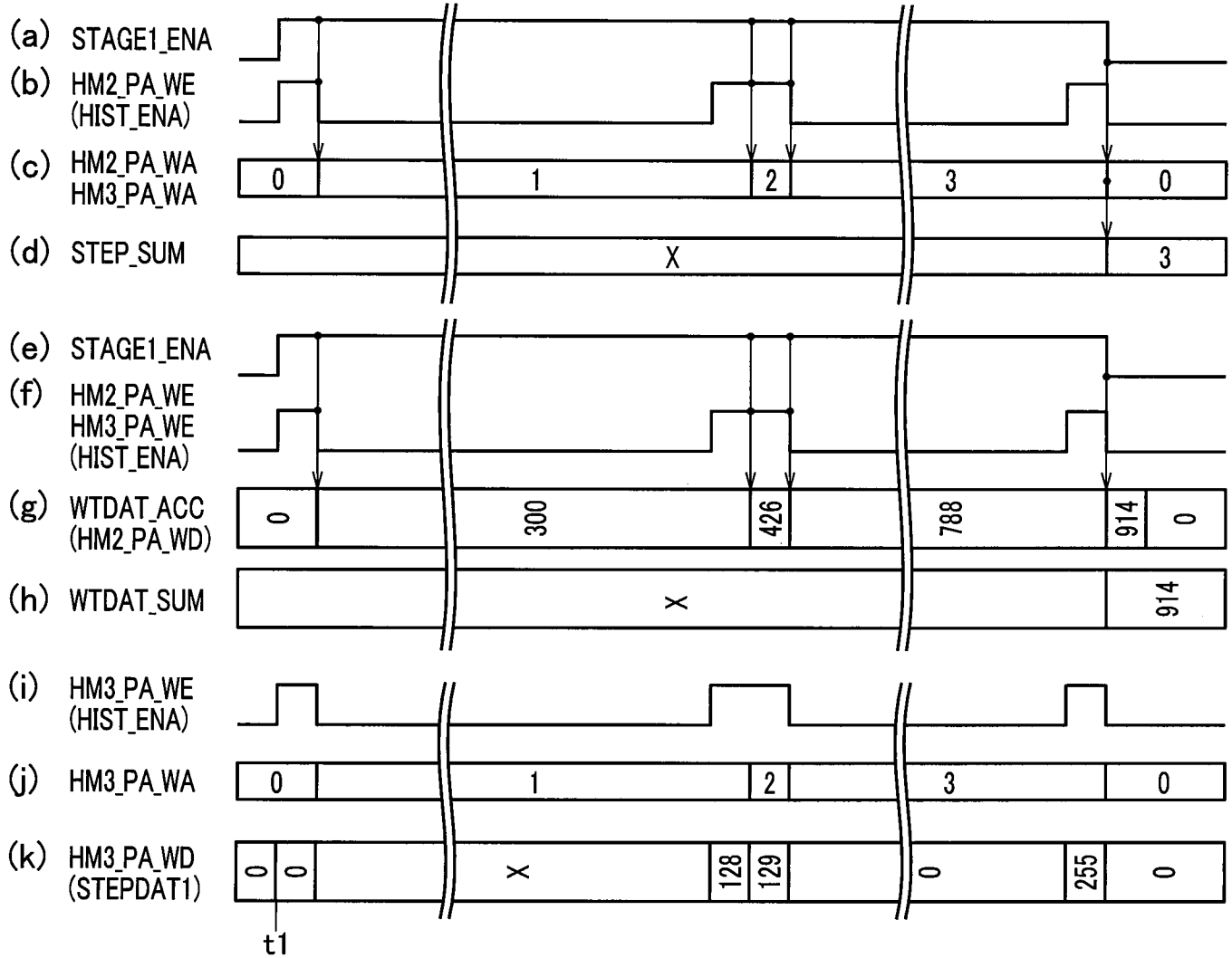
FIG. 9C is a time chart showing a third example of various signals in the gradation histogram generator, the display gradation number acquisition unit, the first display gradation holding period value generator, the second display gradation holding period value generator, the holding period provisional value generator, and the holding period total value generator.

FIG. 8 shows a configuration example of the gradation histogram generator 41. FIGS. 9A to 9C show, in the form of the time charts, first to third examples of the relationship between various signals in the gradation histogram generator 41, the display gradation number acquisition unit 42, the first display gradation holding period value generator 43, the second display gradation holding period value generator 44, the holding period provisional value generator 45, and the holding period total value generator 46.

In FIG. 9A, (a) denotes the clock signal CLK, (b) and (c) denote input signals to RE terminal and RA terminal of the B port PB of the memory 413, respectively, (d) denotes a output signal from the RE terminal, (e) to (g) denote input signals to WE terminal, WA terminal, and WD terminal, respectively. (b) to (d) of FIG. 9A show that a gradation histogram value described later is read out from the B port PB of the memory 413 asynchronously with the clock signal CLK. (e) to (g) of FIG. 9A show that the grayscale histogram value is cleared and 0 is written to the B port PB of the memory 413 asynchronously with the clock signal CLK.

In FIG. 9B, (a) to (i) denote a display target gradation flag HIST_ENA, a gradation value STEPDAT1, a gradation value STEPDAT2, a gradation value difference STEP_DIF, a multiplication value KSLW, a first display gradation holding period value WTDAT_SLW based on the gradation value difference STEP_DIF, a multiplication value KSTP, a second display gradation holding period value WTDAT_STP based on the number of pixels, and a holding period provisional value WTDAT_SEL, respectively.

The value of the display target gradation flag HIST_ENA is 1 when the gradation histogram is not 0, and 0 otherwise. In the gradation value STEPDAT1, gradation values are obtained when the display target gradation flag HIST_ENA=1. In the gradation value STEPDAT2, the gradation value STEPDAT1 is delayed by one clock, and held until the next gradation value is generated. In the gradation value difference STEP_DIF, a difference is generated by subtracting the gradation value STEPDAT2 from the gradation value STEPDAT1. The minimum value is 0. The multiplication value KSLW is set to 1 here by the later-described calculation.

The first display gradation holding period value WTDAT_SLW is a settling period determined based on a voltage slew rate of the ramp waveform signal VREF. The voltage slew rate indicates the maximum response speed of the voltage. The multiplication value KSTP is set as described later. The second display gradation holding period value WTDAT_STP is a settling period determined based on the ringing generated in the analog ramp waveform of the ramp waveform signal VREF. The holding period provisional value WTDAT_SEL is the larger of the first display gradation holding period value WTDAT_SLW and the second display gradation holding period value WTDAT_STP, and is a determined necessary settling period.

In FIG. 9C, (a) and (e) denote enable signals STAGE1_ENA, (b) denotes an input signal to WE terminal of the A port PA of the memory 72, (c) denotes an input signal to WA terminal of the A port PA of the memory 72 or 481 (a count value HM2_PA_WA or HM3_PA_WA). (d) denotes a display target gradation number STEP_SUM. (f) denotes an input signal to WE terminal of the A port PA of the memory 72 or 481 (the display target gradation flag HIST_ENA).

(g) denotes an input signal to WD terminal of the A port PA of the memory 72 or 481 (a holding period accumulated value WTDAT_ACC). (h) denotes a holding period total value WTDAT_SUM. (i) denotes an input signal to WE terminal of the A port PA of the memory 481 (the display target gradation flag HIST_ENA). (j) denotes an input signal to WA terminal of the A port PA of the memory 481 (the count value HM3_PA_WA), (k) denotes an input signal to WD terminal of the A port PA of the memory 481 (the gradation value STEPDAT1).

In (c) of FIG. 9C, a count value is calculated by incrementing the value by one. In (d), the display target gradation number STEP_SUM is determined. In (g), the required settling period converted to the clock is added to calculate the holding period accumulated value WTDAT_ACC, which is the total settling period. In (h), the holding period total value WTDAT_SUM, which is a necessary total settling period, is determined.

As shown in FIG. 8, the gradation histogram generator 41 includes an enable signal generating circuit 411, a count value generating circuit 412, the memory 413, an adder 414, comparator 415, and AND circuit 416. The enable signal generating circuit 411 and the count value generating circuit 412 are constituted by counters. The horizontal synchronization signal SHD and the clock signal CLK are input to the enable signal generating circuit 411. The clock signal CLK is input to the count value generating circuit 412. The video data VDS, the clock signal CLK, and the data enable signal DE are input to the memory 413.

The enable signal generating circuit 411 generates an enable signal STAGE1_ENA based on the horizontal synchronization signal SHD and the clock signal CLK, and outputs the same to the count value generating circuit 412, the memory 413, the AND circuit 416, and the circuit of the subsequent stage. The count value generating circuit 412 counts up a count value 0, which is the count value when the enable signal STAGE1_ENA is low, by 1 in synchronization with the rising edge of the clock signal CLK each time when the enable signal STAGE1_ENA is at the high level, and outputs thus-obtained count value STAGE1_CNT (8 bits) to the memory 413.

The memory 413 constitutes a display gradation holding unit that holds gradations (display gradations) to be displayed in the video data VDS. The memory 413 is a dual port memory having two control systems allowing writing to and reading from one memory. One system will be referred to as A port PA and the other system will be referred to as B port PB. The A port PA generates a gradation histogram value HV of the video data VDS. The B port PB is for reading or deleting the gradation histogram value HV.

The adder 414 adds a fixed value 1 to the gradation histogram value HV output from RD terminal of the A port PA, and outputs the result to WD terminal of the A port PA. In the A port PA, the video data VDS is input to RA terminal and WA terminal, the data enable signal DE is input to WE terminal, and writing in performed in the memory cells of the memory 413 in synchronization with the clock signal CLK input to WCLK terminal. For example, the bit width of the RA terminal and the WA terminal is 8 bits, and the bit width of the RD terminal and the WD terminal is 11 bits corresponding to the number of pixels 1920 in the horizontal direction.

The enable signal STAGE1_ENA is input from the enable signal generating circuit 411 to RE terminal of the B port PB, and the count value STAGE1_CNT is input from the count value generating circuit 412 to RA terminal of the B port PB. A gradation histogram value HM1_PB_RD (same as the gradation histogram value HV) of the number of pixels for each display gradation level in the order of the display gradation level from 0 to 255 during the high level of the enable signal STAGE1_ENA is output from RD terminal of the B port PB to the comparator 415, and the first display gradation holding period value generator 43 and the second display gradation holding period value generator 44 of the subsequent stage.

In B port PB, the enable signal STAGE1_ENA is input from the enable signal generating circuit 411 to WE terminal, the count value STAGE1_CNT is input from the count value generating circuit 412 to WA terminal, the fixed value 0 is input to WD terminal, and writing is performed in the memory cells of the memory 413 in synchronization with the clock signal CLK input to WCLK terminal.

The gradation histogram value HV is input from the memory 413 to A terminal of the comparator 415, and the fixed value 0 is input to the B terminal of the comparator 415. The comparator 415 compares the gradation histogram value HV with the fixed value 0, and outputs 0 to the AND circuit 416 when HV=0 and outputs 1 when HV=0 is not satisfied.

The AND circuit 416 receives the enable signal STAGE1_ENA from the enable signal generating circuit 411 and the comparison result (0 or 1) from the comparator 415. The AND circuit 416 generates the display target gradation flag HIST_ENA, which is an effective display gradation flag that has the high level when the enable signal STAGE1_ENA is at the high level and HV=0 is not satisfied, and that has the low level otherwise, and output the display target gradation flag HIST_ENA to the first display gradation holding period value generator 43 and the display gradation number acquisition unit 42 of the subsequent stage.

The gradation histogram generator 41 accumulates number of pixels of each display gradation during the period when the data enable signal DE is at the high level at the A port PA of the memory 413. Furthermore, the gradation histogram generator 41 sequentially reads, from the B port PB, the number of pixels (gradation histogram value) for each display gradation from 0 to 255 during 256 clock periods corresponding to 256 (8 bits) displayable gradations from the time when the data enable signal DE becomes low (when the horizontal synchronization signal SHD becomes high), and writes 0 in the memory cells in synchronization with the clock signal CLK. Accordingly, the gradation histogram generator 41 executes an initial clear of the cumulative addition of the A port PA of the next line.

The clock signal CLK, the display target gradation flag HIST_ENA, and the enable signal STAGE1_ENA are input to the display gradation number acquisition unit 42. The display gradation number acquisition unit 42 obtains the number of display gradations in one horizontal scanning period and outputs the same to the holding period optimum value generator 47.

Figure 10:
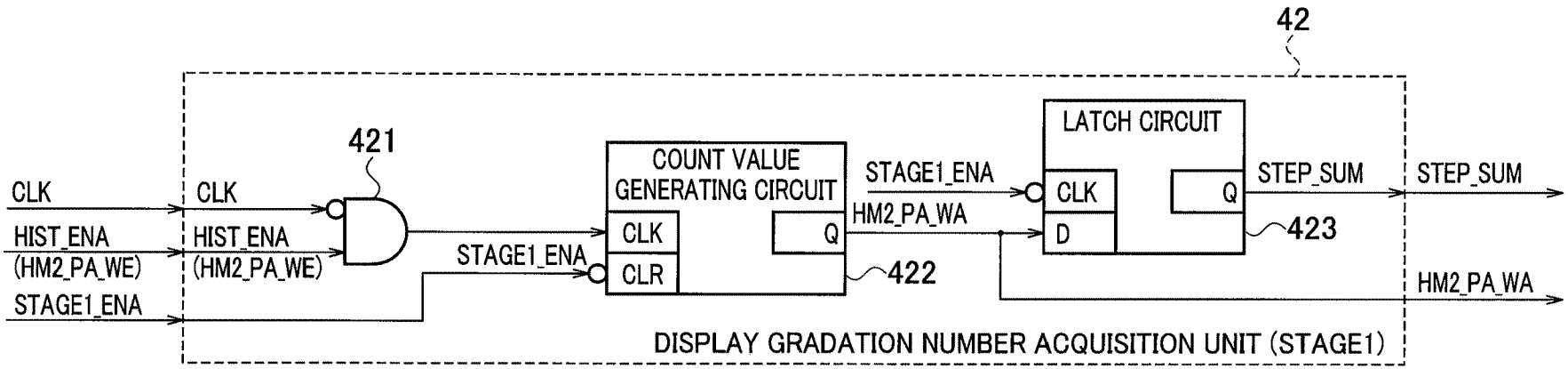
FIG. 10 is a block diagram showing an example of the display gradation number acquisition unit.

FIG. 10 shows a configuration example of the display gradation number acquisition unit 42. The display gradation number acquisition unit 42 includes an AND circuit 421, count value generating circuit 422, and a latch circuit 423 (8-bit latch). In the count value generating circuit 422, the clock signal CLK, which is input to the AND circuit 421, and the display target gradation flag HIST_ENA are input as clocks, and the enable signal STAGE1_ENA is input as a clear.

The count value generating circuit 422 generates the count value HM2_PA_WA and outputs the same to the latch circuit 423 and the holding period optimum value generator 47. The enable signal STAGE1_ENA and the count value HM2_PA_WA are input to the latch circuit 423. The latch circuit 423 latches the count value HM2_PA_WA at the falling edge of the enable signal STAGE1_ENA, and outputs the latching result as the display target gradation number STEP_SUM to the holding period optimum value generator 47.

The display gradation number acquisition unit 42 can obtain the display target gradation number STEP_SUM that is the number of gradations to be displayed during one horizontal scanning period held from the time when the enable signal STAGE1_ENA becomes the low level to the time when the next enable signal STAGE1_ENA becomes the low level. The display gradation number acquisition unit 42 outputs the display target gradation number STEP_SUM to the holding period optimum value generator 47. The display gradation number acquisition unit 42 clears the gradation number to 0 when the display target gradation flag HIST_ENA is at the low level, and outputs the count value HM2_PA_WA, which updates the the number of gradations each time the display target gradation flag HIST_ENA becomes the high level, to the latch circuit 423 and the holding period optimum value generator 47.

The display target gradation flag HIST_ENA, the gradation histogram value HV (HM1_PB_RD), and the clock signal CLK are input to the first display gradation holding period value generator 43. The first display gradation holding period value generator 43 generates a gradation value difference STEP_DIF between each display gradation and a lower (e.g., black level) or a higher (e.g., white level) gradation value from the one previous display gradation in the gradation direction (that is, the gradation value difference between two adjacent display gradations), and the first display gradation holding period value WTDAT_SLW corresponding to a period for holding the display gradation determined based on a voltage slew rate of the ramp waveform signal VREF, and outputs them to the holding period provisional value generator 45.

Figure 11:
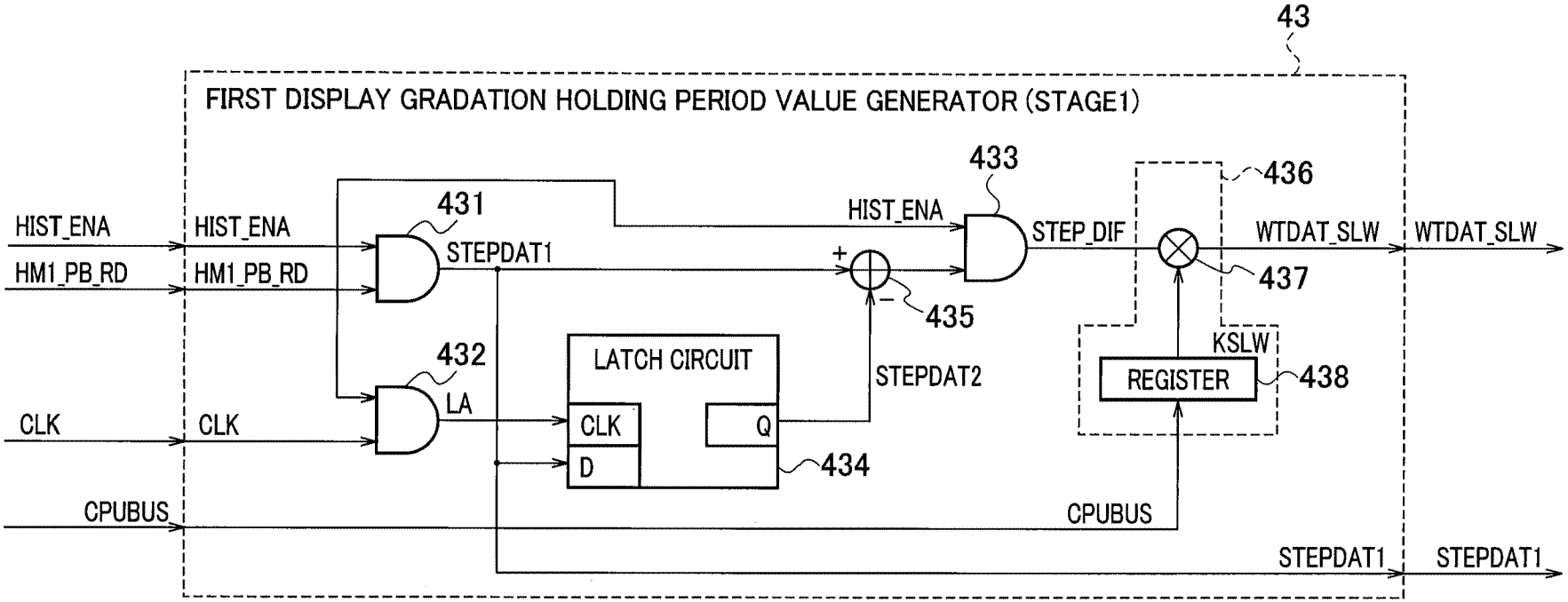
FIG. 11 is a block diagram showing an example of the first display gradation holding period value generator.

FIG. 11 shows a configuration example of the first display gradation holding period value generator 43. The first display gradation holding period value generator 43 includes AND circuits 431 to 433, a latch circuit 434 (11-bit latch), an adder 435, and a first display gradation holding period value generating circuit 436 based on the gradation value difference STEP_DIF. The display target gradation flag HIST_ENA and the gradation histogram value HV (HM1_PB_RD) are input to the AND circuit 431. The display target gradation flag HIST_ENA and the clock signal CLK are input to the AND circuit 432.

The AND circuit 431 outputs the gradation histogram value HV during the period when the display target gradation flag HIST_ENA is at the high level, as the gradation value STEPDAT1 (11 bits) of all bits 0 in all other periods, to the adder 435, the latch circuit 434, and the holding period provisional value generator 45 of the subsequent stage. The AND circuit 432 outputs a logical product LA of the display target gradation flag HIST_ENA and the clock signal CLK to the latch circuit 434. The latch circuit 434 latches the gradation value STEPDAT1 with the logical product LA, and outputs the result to the adder 435 as the gradation value STEPDAT2 (11 bits). The gradation value STEPDAT2 corresponds to the gradation value STEPDAT1 at the point in time when the display target gradation flag HIST_ENA became the high level one previous time.

The adder 435 calculates the difference DF between the gradation value STEPDAT1 and the gradation value STEPDAT2, and outputs the same to the AND circuit 433. The display target gradation flag HIST_ENA and the difference DF are input to the AND circuit 433. The AND circuit 433 obtains the gradation value difference STEP_DIF (11 bits) of the display gradations by generating a logical product of the display target gradation flag HIST_ENA and the difference DF. The AND circuit 433 outputs the gradation value difference STEP_DIF to the first display gradation holding period value generating circuit 436.

The first display gradation holding period value generating circuit 436 includes a multiplier 437 and a register 438. The register 438 is a register set by an unillustrated CPU (Central Processing Unit) that is connected via a CPU bus CPUBUS, and the CPU can change the register value thereof according to the slew rate characteristic. The register value of the register 438 is a multiplication value for outputting the number of gradation counter clocks corresponding to a voltage transition period corresponding to the difference in the gradation value, according to the voltage and current capability of the ramp waveform signal generating circuit 3 of the subsequent stage, the wiring impedance up to the selection circuit 65 in the liquid crystal device 5, and the voltage slew rate characteristic determined by the input impedance of an unillustrated analog switch inside the selection circuit 65.

The multiplier 437 calculates the first display gradation holding period value WTDAT_SLW by taking the gradation value difference STEP_DIF as a to be multiplied value and the multiplication value KSLW (11 bits) of the register 438 as a multiplication value (multiplication coefficient), and outputs the same to the holding period provisional value generator 45.

An example of a method for setting the multiplication value KSLW will be described now. It is assumed that the minimum output voltage of the ramp waveform signal generating circuit 3 is 0 V and the maximum output voltage thereof is 2.55 V. Also, only the voltage and current capabilities of the ramp waveform signal generating circuit 3 are considered, and the voltage slew rate characteristic is taken as the common value, that is, 1.484 V/μs. Moreover, the frequency of the gradation counter clock signal ACLK is taken as 148.4 MHz.

In the gradation histogram value HV, the display gradation is from 0 to 128, the ramp waveform signal VREF changes from 0 V to 1.28 V, and thus, the difference voltage is 1.28 V. In this example, when the period until the ramp waveform signal VREF reaches the target voltage is represented by the number of clocks of the gradation counter clock signal ACLK, based on the relational expression 1.28 V/1.484 V/μs×148.4 MHz=128, the number of clocks of the gradation counter clock signal ACLK becomes 128. Accordingly, the register 438 divides the number of clocks (128) of the gradation counter clock signal ACLK by the display gradation 128, and sets the multiplication value KSLW to 1.

Instead of having the multiplier 437 the first display gradation holding period value generating circuit 436 may have a lookup table in which the address of the display gradation difference is used as an address, and the first display gradation holding period value WTDAT_SLW is used as data, for example. By making the first display gradation holding period value WTDAT_SLW non-linear with respect to the display gradation difference, it is possible to cope with a desired slew rate characteristic.

Figure 12:
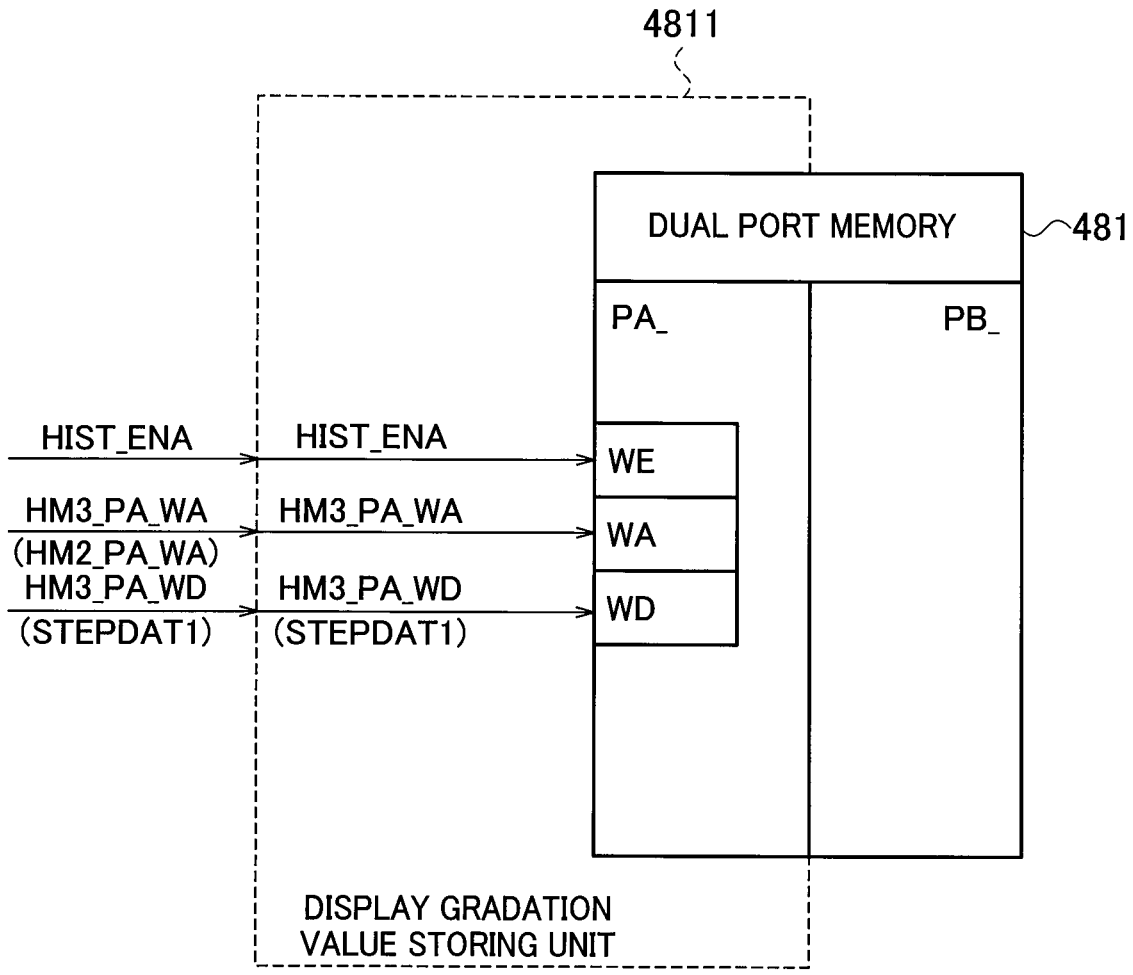
FIG. 12 is a configuration diagram illustrating an example of a display gradation value storing unit.

As shown in FIG. 12, a memory 481 is a dual port memory. The memory 481 is provided in the display gradation conversion data generator 48. The A port PA of the memory 481 is a display gradation value storing unit 4811. The display gradation value storing unit 4811 writes the gradation value HM3_PA_WD (STEPDAT1) to the memory cells of the memory 481 by using the display target gradation flag HIST_ENA as enable and the count value HM3_PA_WA (same as the count value HM2_PA_WA) as an address.

The gradation histogram value HV is input from the gradation histogram generator 41 to the second display gradation holding period value generator 44. The second display gradation holding period value generator 44 generates the number of each display gradation and the second display gradation holding period value WTDAT_STP corresponding to the time to hold the display gradation determined by the settling period in which the ringing of the ramp waveform signal VREF, which is generated by the number of each display gradation, attenuates to a level that does not affect the displayed image, and outputs the same to the holding period provisional value generator 45.

Figure 13:
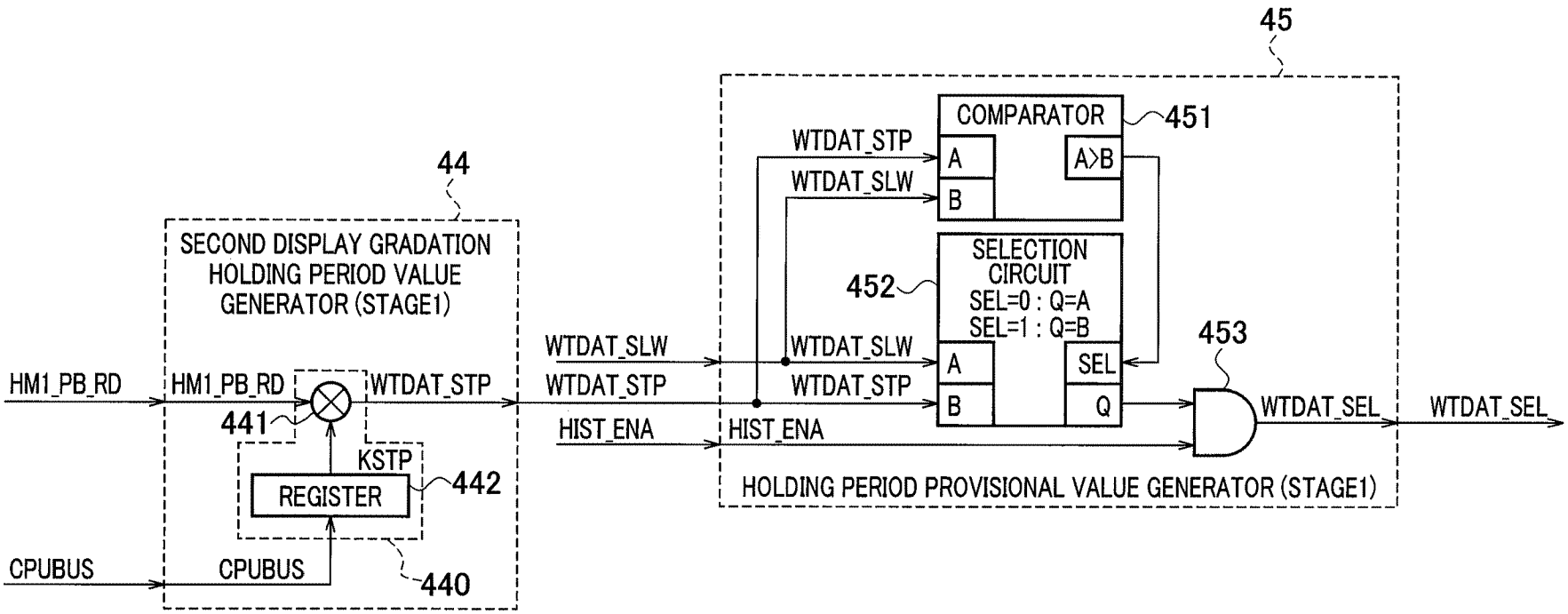
FIG. 13 is a configuration diagram illustrating examples of the second display gradation holding period value generator and the holding period provisional value generator.

FIG. 13 shows a configuration example of the second display gradation holding period value generator 44 and the holding period provisional value generator 45. The second display gradation holding period value generator 44 includes a multiplier 441 and a register 442. The register 442 is a register set by a CPU that is connected via a CPU bus CPUBUS. The CPU calculates a settling period until the ringing caused by the number of pixels attenuates, and sets a register value, based on the number of clocks of the gradation counter clock signal ACLK, in the register 442. The multiplier 441 takes the gradation histogram value HV (HM1_PB_RD) as "a to be multiplied value", obtains the second display gradation holding period value WTDAT_STP by multiplying the "to be multiplied value" with the multiplication value (multiplication coefficient) KSTP (11 bits) of the register 442, and outputs the result to the holding period provisional value generator 45. The multiplier 441 and the register 442 constitute a second display gradation holding period value generating circuit based on the number of pixels.

Instead of the multiplier 441 the second display gradation holding period value generator 44 may have a lookup table in which the number of pixels is used as an address, and the second display gradation holding period value WTDAT_STP is used as data, for example. By making the second display gradation holding period value WTDAT_STP non-linear with respect to the number of display pixels of each display gradation, it is possible to cope with a desired settling period.

The first display gradation holding period value WTDAT_SLW, the second display gradation holding period value WTDAT_STP, and the display target gradation flag HIST_ENA are input to the holding period provisional value generator 45. The holding period provisional value generator 45 compares the first display gradation holding period value WTDAT_SLW with the second display gradation holding period value WTDAT_STP, and selects the display gradation holding period value having the larger value, and output the selected display gradation holding period value as the holding period provisional value WTDAT_SEL to the holding period total value generator 46.

The holding period provisional value generator 45 includes a comparator 451, a selection circuit 452, and an AND circuit 453. The first display gradation holding period value WTDAT_SLW and the second display gradation holding period value WTDAT_STP are input in the comparator 451 and the selection circuit 452. The comparator 451 outputs an output signal, which becomes the high level when the second display gradation holding period value WTDAT_STP is greater than the first display gradation holding period value WTDAT_SLW and that is otherwise at the low level, to a selection control input terminal (SEL) of the selection circuit 452.

The selection circuit 452 outputs, from a Q terminal thereof to the AND circuit 453, the second display gradation holding period value WTDAT_STP when the output signal input to the selection control input terminal (SEL) is at the high level and outputs the first display gradation holding period value WTDAT_SLW when the output signal is at the low level.

The second display gradation holding period value WTDAT_STP or the first display gradation holding period value WTDAT_SLW, and the display target gradation flag HIST_ENA are input to the AND circuit 453. The AND circuit 453 calculates the logical product of the second display gradation holding period value WTDAT_STP or the first display gradation holding period value WTDAT_SLW and the display target gradation flag HIST_ENA, and outputs the result as the holding period provisional value WTDAT_SEL to the holding period total value generator 46.

That is, the holding period provisional value generator 45 generates the holding period provisional value WTDAT_SEL by selecting the larger value between the second display gradation holding period value WTDAT_STP and the first display gradation holding period value WTDAT_SLW.

The clock signal CLK, the holding period provisional value WTDAT_SEL, and the enable signal STAGE1_ENA are input to the holding period total value generator 46. The holding period total value generator 46 generates the holding period total value WTDAT_SUM, which is the sum of the holding period provisional values WTDAT_SEL during one horizontal scanning period, and outputs the same to the holding period optimum value generator 47.

Figure 14:
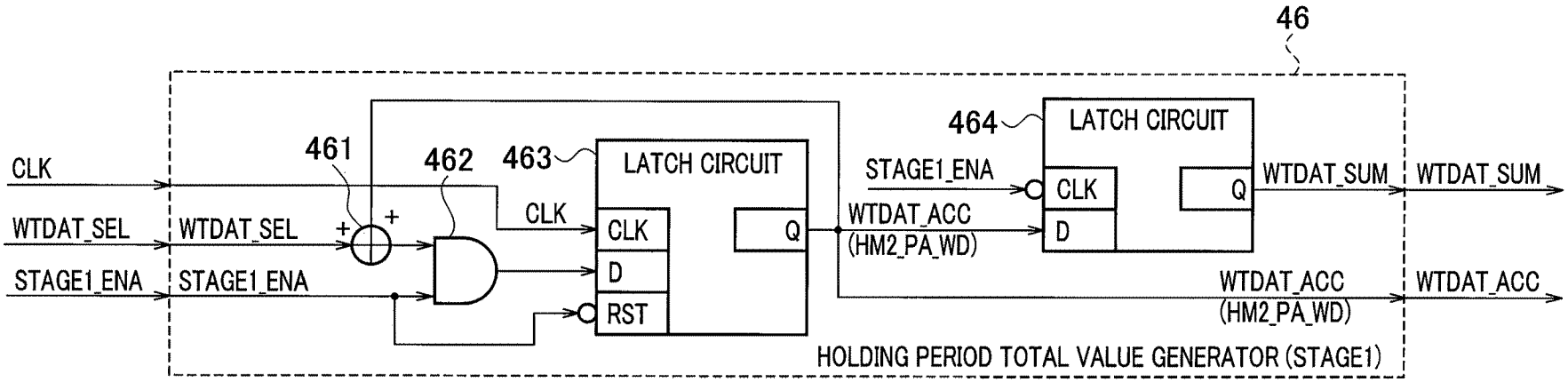
FIG. 14 is a block diagram showing an example of the holding period total value generator.

FIG. 14 shows a configuration example of the holding period total value generator 46. The holding period total value generator 46 includes an adder 461, an AND circuit 462, and latch circuits 463 and 464. The latch circuits 463 and 464 are one-clock delay elements, for example. The holding period provisional value WTDAT_SEL and the holding period accumulated value WTDAT_ACC output from the latch circuit 463 are input to the adder 461. The adder 461 adds the holding period provisional value WTDAT_SEL and the holding period accumulated value WTDAT_ACC, and outputs the addition result to the AND circuit 462. The AND circuit 462 outputs the logical product of the addition result output from the adder 461 and the enable signal STAGE1_ENA to D terminal of the latch circuit 463.

The clock signal CLK, the enable signal STAGE1_ENA, and the logical product output from the AND circuit 462 are input to the latch circuit 463. The latch circuit 463 clears the holding period accumulated value WTDAT_ACC to 0 when the enable signal STAGE1_ENA is at the high level. The latch circuit 463, when the enable signal STAGE1_ENA is at the low level, takes the logical product input to the D terminal as the holding period accumulated value WTDAT_ACC at the rising edge of the clock signal CLK input to the CLK terminal, and outputs the same to the adder 461, the latch circuit 464, and the holding period optimum value generator 47 of the subsequent stage. That is, the latch circuit 463 outputs, as the holding period accumulated value WTDAT_ACC, a cumulative addition value of the holding period provisional value WTDAT_SEL during the period when the enable signal STAGE1_ENA is at the high level.

The enable signal STAGE1_ENA and the holding period accumulated value WTDAT_ACC are input to the latch circuit 464. At the falling time of the enable signal STAGE1_ENA, the latch circuit 464 outputs the holding period accumulated value WTDAT_ACC as the holding period total value WTDAT_SUM to the holding period optimum value generator 47 of the subsequent stage.

That is, the holding period total value generator 46 generates a total value (holding period total value WTDAT_SUM) of the cumulative addition value of the holding period accumulated values WTDAT_ACC, which is a cumulative addition value of the holding period provisional values WTDAT_SEL in the period when the enable signal STAGE1_ENA is at the high level, and the holding period provisional value WTDAT_SEL during one horizontal scanning period, and outputs the same to the holding period optimum value generator 47.

Figure 15:
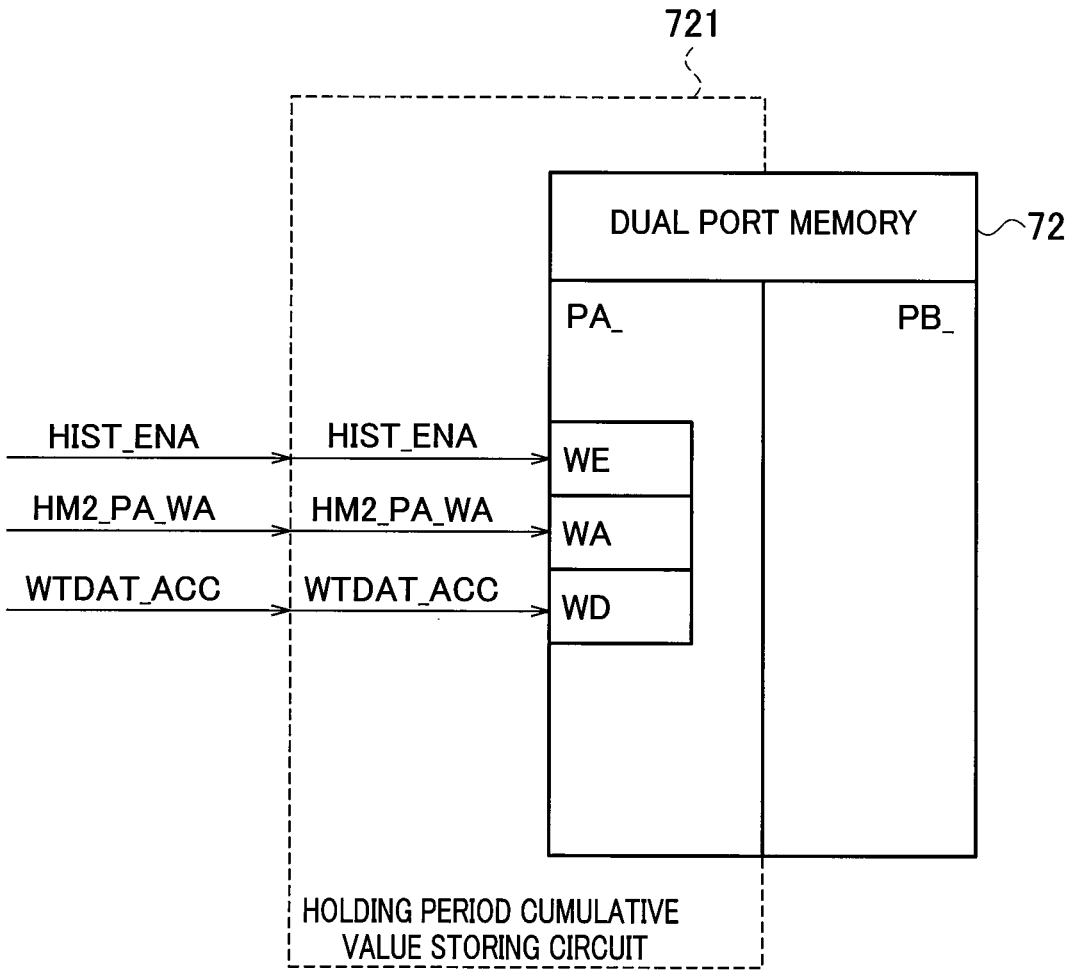
FIG. 15 is a configuration diagram illustrating an example of a holding period cumulative value storing circuit.

The holding period optimum value generator 47 includes a memory 72 shown in FIG. 15. The memory 72 is a dual port memory. The A port PA of the memory 72 is a holding period cumulative value storing circuit 721. The holding period cumulative value storing circuit 721 writes the holding period accumulated value WTDAT_ACC to the memory cells of the memory 72 by using the display target gradation flag HIST_ENA as enable and the count value HM2_PA_WA as an address.

The holding period optimum value generator 47 receives the count value HM2_PA_WA, the holding period accumulated value WTDAT_ACC, the display target gradation number STEP_SUM, the holding period provisional value WTDAT_SEL, and the holding period total value WTDAT_SUM. The holding period optimum value generator 47 generates a holding period optimum value WTDAT_CMPRS for each display gradation from the number of displayable gradations in one horizontal scanning period, the display target gradation number STEP_SUM, and the holding period total value WTDAT_SUM.

FIGS. 16 to 20 show configuration examples of the holding period optimum value generator 47. FIGS. 21A and 21B show time charts indicating first and second examples, respectively, of the relationship between various signals in the holding period optimum value generator 47 and the display gradation conversion data generator 48.

In FIG. 21A, (a) denotes the clock signal CLK, (b) denotes the enable signal STAGE2_ENA, (c) denotes the display target gradation number STEP_SUM. (d) denotes a count value STAGE2_CNT, (e) denotes a logical product HM2_PB_RE to be described later, (f) denotes a logical product GDATED_HM2_PB_RD to be described later, (g) denotes the holding period total value WTDAT_SUM. (a) to (c) and (g) in FIG. 21A are generated in the STAGE 1.

In (d) of FIG. 21A, the count value STAGE2_CNT is generated, in which the count value STAGE2_CNT is incremented when the enable signal STAGE2_ENA is 1, and the count value STAGE2_CNT is 0 otherwise. In (e) of FIG. 21A, the logical product HM2_PB_RE is generated, in which the logical product HM2_PB_RE becomes 1 when the count value STAGE2_CNT matches the display target gradation number STEP_SUM, and becomes 0 otherwise. In (f) of FIG. 21A, the logical product GDATED_HM2_PB_RD is generated, in which the logical product GDATED_HM2_PB_RD becomes 0 when the logical product HM2_PB_RE is 0, and becomes the data HM2_PB_RD read from RD terminal of the B port PB of the memory 72 otherwise.

In FIG. 21B, (a) denotes the holding period optimum value WTDAT_CMPRS, (b) denotes a holding period cumulative optimum value WTDAT_CMPRS_ACC to be described later, (c) denotes an input signal HM3_PB_RA that is input to RA terminal of the B port PB of the memory 481, (d) denotes the count value STAGE2_CNT that is an input signal HM3_PB_RA to RA terminal of the B port PB of the memory 481, (e) denotes a display gradation value HM3_PB_RD that is an output signal from RD terminal of the B port PB of the memory 481, (f) denotes an input signal HM4_PA_WD input to WD terminal of the A port PA of a memory 482.

The holding period optimum value WTDAT_CMPRS shown in (a) of FIG. 21B is obtained by HM2_PB_RD× [256−(STEP_SUM+1)/WTDAT_SUM. The holding period cumulative optimum value WTDAT_CMPRS_ACC shown in (b) of FIG. 21B is cleared when the enable signal STAGE2_ENA is 0, and otherwise obtained by cumulatively adding the holding period optimum value WTDAT_CMPRS. The holding period cumulative optimum value WTDAT_CMPRS_ACC is a cumulative addition value of the input signal HM5_PA_WD to WD terminal of the A port PA of a memory 480 shown in FIG. 20.

In FIG. 21B, (c) to (f) indicate that the gradation conversion value is stored in the memory 482. The input signal HM4_PA_WD has a value of 0 when the holding period cumulative optimum value WTDAT_CMPRS_ACC is 0, and has a value obtained by subtracting 1 from the holding period cumulative optimum value WTDAT_CMPRS_ACC otherwise.

Figure 16:
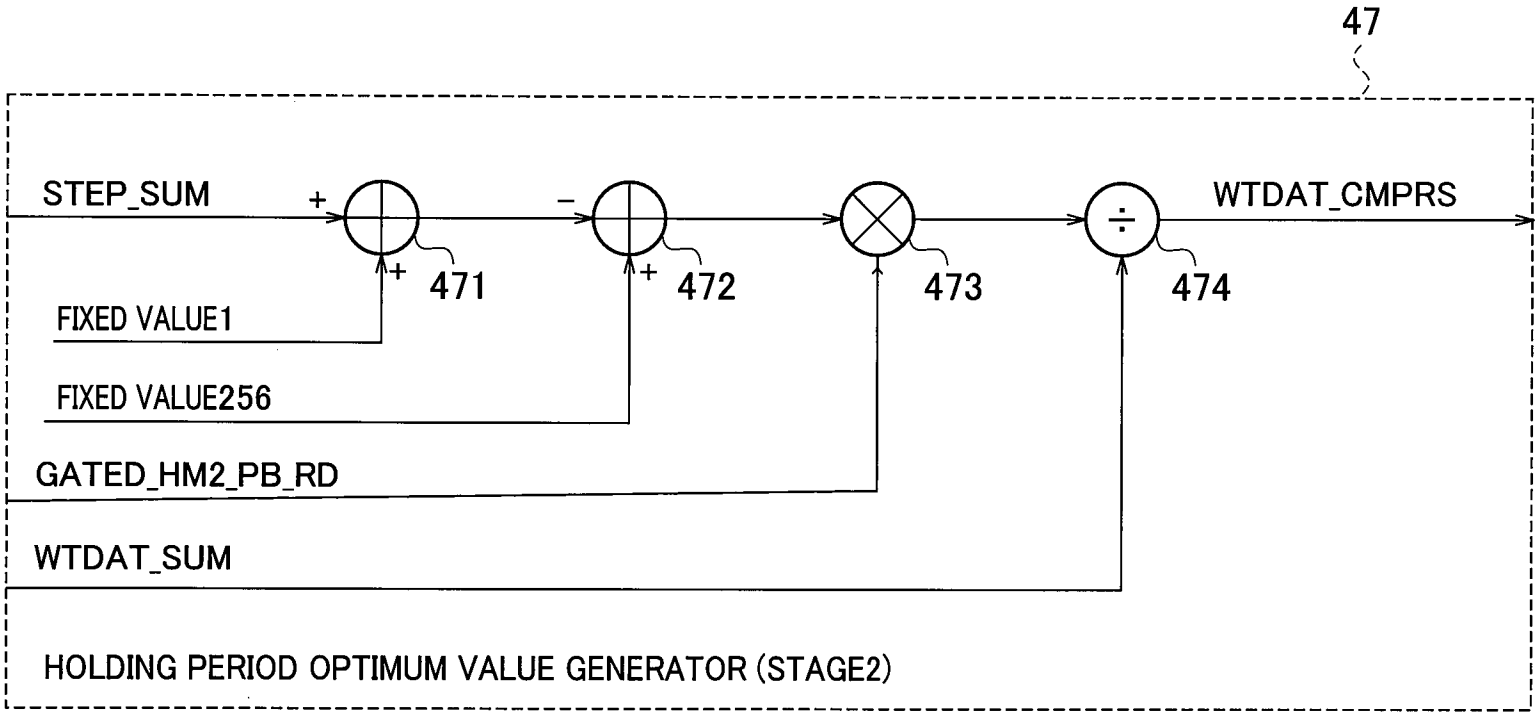
FIG. 16 is a configuration diagram illustrating an example of a holding period optimum value generator.
Figure 17:
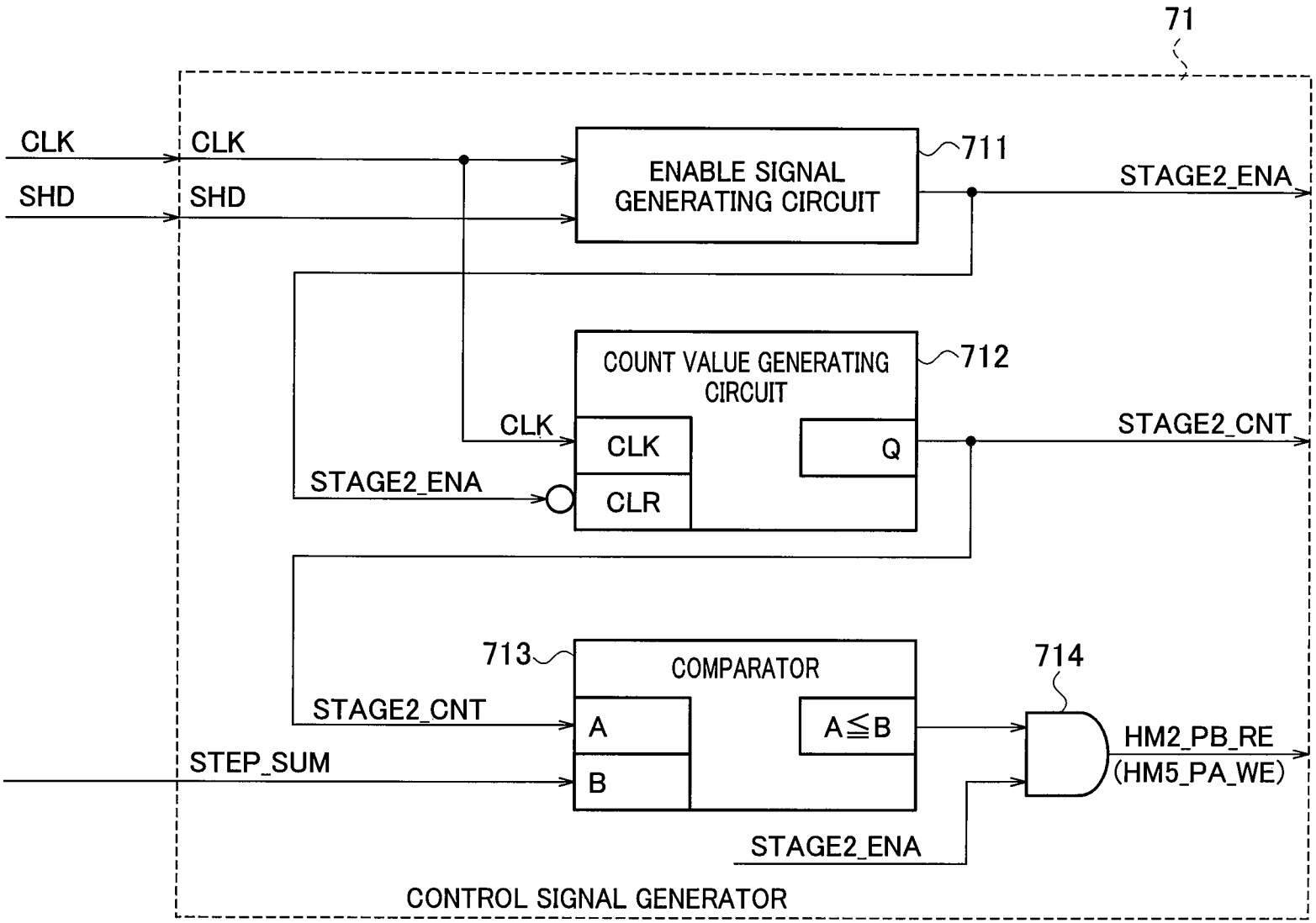
FIG. 17 is a block diagram showing an example of a control signal generator.
Figure 18:
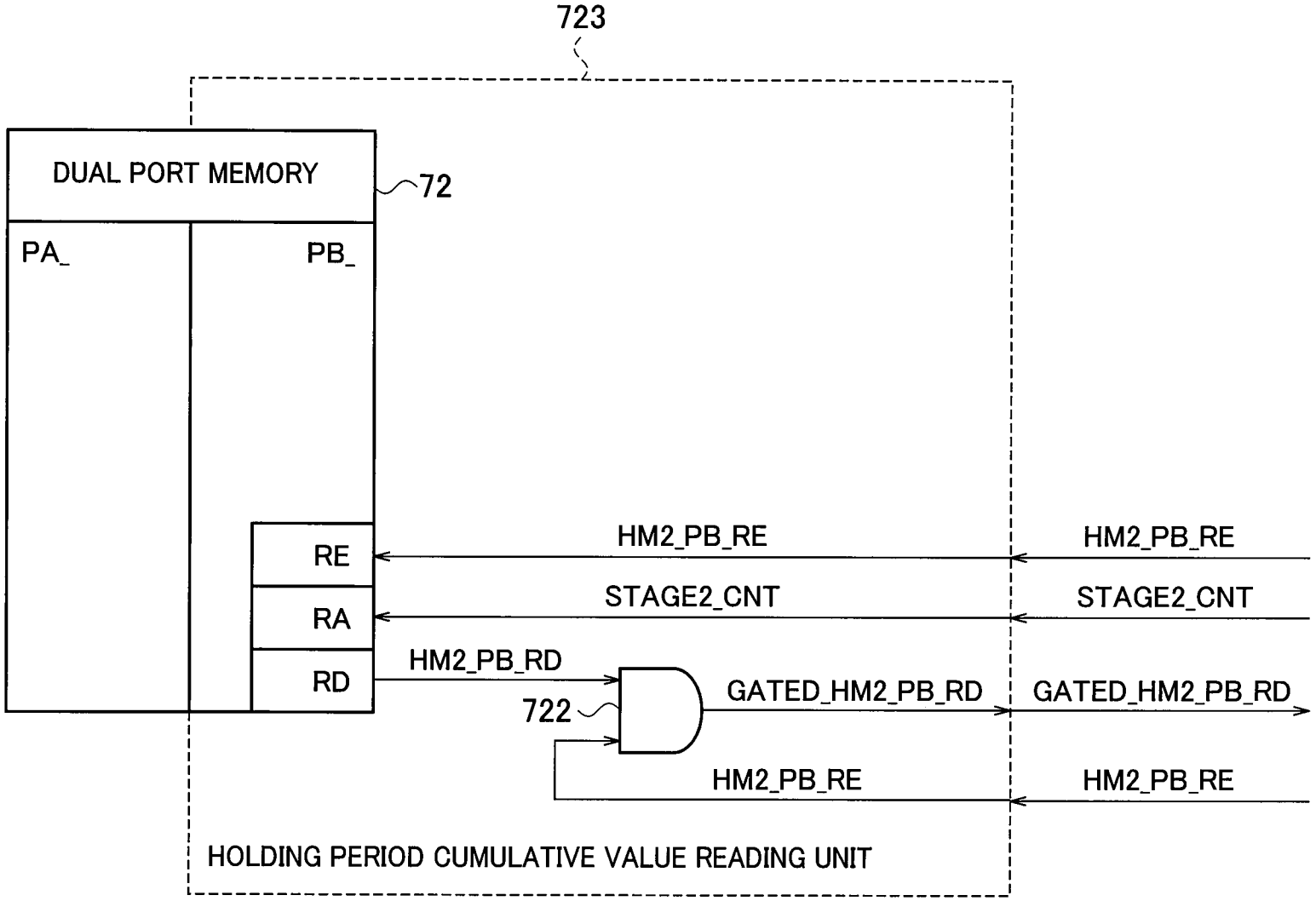
FIG. 18 is a configuration diagram illustrating an example of a holding period cumulative value reading unit.
Figure 19:
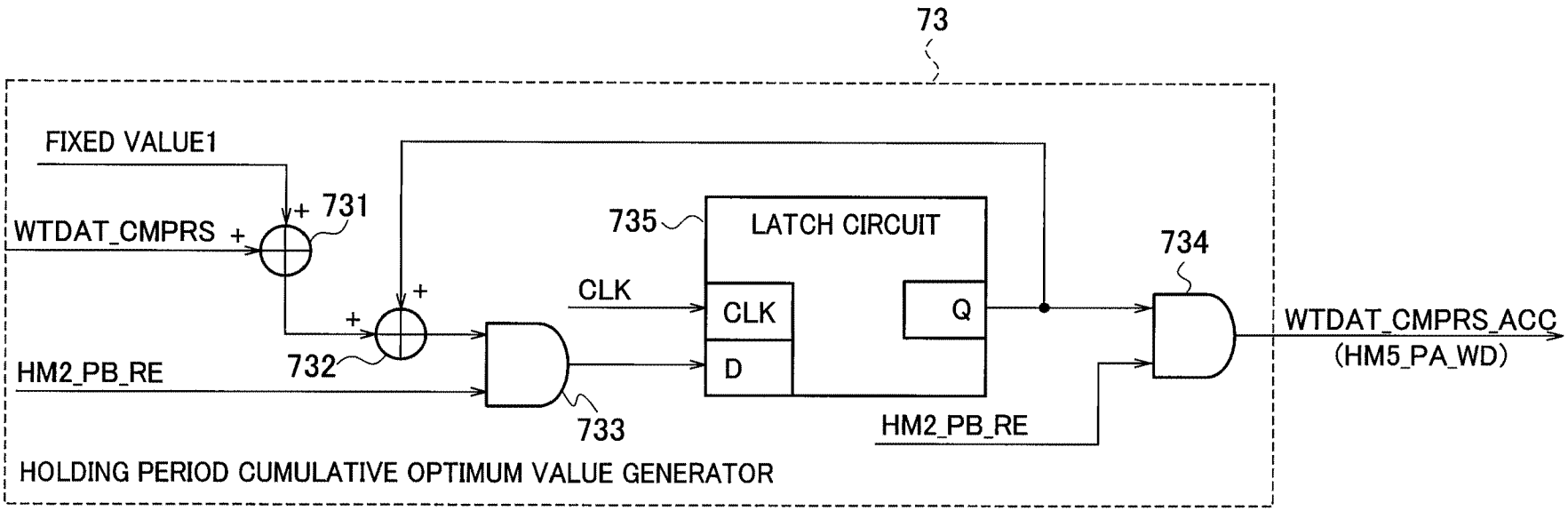
FIG. 19 is a configuration diagram illustrating an example of a holding period cumulative optimum value generator.

As shown in FIG. 16, the holding period optimum value generator 47 includes adders 471 and 472, a multiplier 473, and a divider 474. As shown in FIGS. 17 to 19, the holding period optimum value generator 47 includes a control signal generator 71, memories 72 and 483, and a holding period cumulative optimum value generator 73.

FIG. 17 shows a configuration example of the control signal generator 71. The clock signal CLK, the horizontal synchronization signal SHD, and the display target gradation number STEP_SUM are input to the control signal generator 71. The control signal generator 71 includes an enable signal generating circuit 711, a count value generating circuit 712, a comparator 713, and an AND circuit 714. The enable signal generating circuit 711 and the count value generating circuit 712 are constituted by counters.

The clock signal CLK and the horizontal synchronization signal SHD are input to the enable signal generating circuit 711. The enable signal generating circuit 711 generates the enable signal STAGE2_ENA based on the clock signal CLK and the horizontal synchronization signal SHD, and outputs the same to the count value generating circuit 712 and the AND circuit 714.

The clock signal CLK and the enable signal STAGE2_ENA are input to the count value generating circuit 712. The count value generating circuit 712 generates to a count value 0 when the enable signal STAGE2_ENA is at the low level. The count value generating circuit 712 generates to output a count value STAGE2_CNT (8 bits) to the comparator 713 and the holding period cumulative value reading unit 723 of the subsequent stage. The count value STAGE2_CNT is obtained by counting up by one in synchronization with the rising edge of the clock signal CLK when the enable signal STAGE2_ENA is at the high level.

The count value STAGE2_CNT and the display target gradation number STEP_SUM are input to the comparator 713. The comparator 713 outputs an output signal to the AND circuit 714. This output signal is at the high level when the count value STAGE2_CNT is equal to or less than the display target gradation number STEP_SUM, and otherwise the output signal is at the low level.

The enable signal STAGE2_ENA and the output signal output from the comparator 713 are input to the AND circuit 714. The AND circuit 714 calculates a logical product HM2_PB_RE (HM5_PA_WE) of the enable signal STAGE2_ENA and the output signal output from the comparator 713, and outputs the result to the holding period cumulative value reading unit 723 and the holding period cumulative optimum value generator 73 of the subsequent stage.

As shown in FIG. 18, the B port PB of the memory 72 and the AND circuit 722 constitute the holding period cumulative value reading unit 723. To the B port PB of the memory 72, the logical product HM2_PB_RE is input as enable, and the count value STAGE2_CNT is input as an address. The B port PB of the memory 72 outputs the data HM2_PB_RD stored in the memory cells to the AND circuit 722.

The data HM2_PB_RD and the logical product HM2_PB_RE are input to the AND circuit 722. The AND circuit 722 calculates the logical product GATED_HM2_PB_RD of the data HM2_PB_RD and the logical product HM2_PB_RE, and outputs the result to the multiplier 473 of the holding period optimum value generator 47. The holding period cumulative value reading unit 723 reads the holding period accumulated value stored in STAGE1 in accordance with the count value STAGE2_CNT that is sequentially counted up during a period when the logical product HM2_PB_RE is at the high level.

As shown in FIG. 16, the adder 471 adds the fixed value 1 to the display target gradation number STEP_SUM, and outputs the addition result to the adder 472. The adder 472 adds the fixed value 256 to the addition result of the adder 471, and outputs the addition result to the multiplier 473. The multiplier 473 multiplies the addition result of the adder 472 by the logical product GATED_HM2_PB_RD, and outputs the multiplication result to the divider 474. The divider 474 divides the multiplication result by the holding period total value WTDAT_SUM, and outputs a division result as the holding period optimum value WTDAT_CMPRS to the holding period cumulative optimum value generator 73 of the subsequent stage.

The holding period optimum value WTDAT_CMPRS can be calculated by the relational expression WTDAT_CMPRS=(256−(STEP_SUM+1))×(GATED_HM2_PB_RD/WTDAT_SUM). The (STEP_SUM+1) in this relational expression is the actual display gradation number. For example, when video data (gradation 0) of one horizontal scanning period of 1 to 599 lines is used, the display gradation number will be 1, because the display gradation is only 0, however, the display target gradation number STEP_SUM will be 0. Therefore, the actual display gradation number is obtained from the addition result (STEP_SUM+1) obtained by adding 1 to the display target gradation number STEP_SUM in the adder 472.

Therefore, (256−(STEP_SUM+1)) in the above relational expression can be expressed as (256−actual display gradation number). The above relational expression relates to a case in which the number of gradations of the video data VDS is 256 (0 to 255 represented by 8 bits8). The gradation number of the video data VDS matches the gradation counter value QD of the liquid crystal device 5. That is, (256−actual display gradation number) is a value obtained by subtracting the display gradation number from the count number 256 of the gradation counter value QD, and is a gradation count number that can be used as a gradation holding period.

The logical product GATED_HM2_PB_RD in (GATED_HM2_PB_RD/WTDAT_SUM) in the above relational expression is a value obtained by sequentially accumulating a display gradation holding period value for each display gradation by one horizontal scanning period, and the total value thereof is the holding period total value WTDAT_SUM. That is, (GATED_HM2_PB_RD/WTDAT_SUM) is a value (0 or more and 1 or less) obtained by normalizing the display gradation holding period value for each display gradation by the sum thereof.

Therefore, the holding period optimum value WTDAT_CMPRS is obtained by calculating the gradation count number that can be used as the gradation holding period according to the ratio of the display gradation holding period value for each normalized display gradation. In addition, the holding period optimum value WTDAT_CMPRS is a count number obtained by counting one gradation to be displayed during one horizontal scanning period and allocating the display gradation holding period to the remaining count.

FIG. 19 shows a configuration example of the holding period cumulative optimum value generator 73. The holding period optimum value WTDAT_CMPRS and the logical product HM2_PB_RE are input to the holding period cumulative optimum value generator 73. The holding period cumulative optimum value generator 73 includes adders 731 and 732, AND circuits 733 and 734, and a latch circuit 735. The latch circuit 735 is a one-clock delay element, for example.

The adder 731 adds the fixed value 1 to the holding period optimum value WTDAT_CMPRS, and outputs the addition result to the adder 732. The adder 732 adds the addition result of the adder 731 and the output value output from Q terminal of the latch circuit 735, and outputs the addition result to the AND circuit 733. The AND circuit 733 outputs a logical product of the addition result of the adder 732 and the logical product HM2_PB_RE to the latch circuit 735. The logical product is input to D terminal of the latch circuit 735 and the clock signal CLK is input to CLK terminal thereof. The latch circuit 735 outputs, from Q terminal thereof, the logical product input to the D terminal to the adder 732 and the AND circuit 734 at the rising edge of the clock signal CLK.

The logical product HM2_PB_RE and the output value output from the Q terminal of the latch circuit 735 are input to the AND circuit 734. The AND circuit 734 calculates a logical product of this output value and the logical product HM2_PB_RE, and outputs the result as the holding period cumulative optimum value WTDAT_CMPRS_ACC to the display gradation conversion data generator 48 of the subsequent stage.

The holding period cumulative optimum value generator 73 clears the holding period cumulative optimum value WTDAT_CMPRS_ACC to 0 when the logical product HM2_PB_RE is at the low level, otherwise takes a value obtained by adding the holding period optimum value WTDAT_CMPRS to 1, which corresponds to the count of the gradation counter for display gradation to be displayed, as a value obtained by performing cumulative addition for 1 horizontal scanning period. The holding period cumulative optimum value generator 73 generates the holding period cumulative optimum value WTDAT_CMPRS_ACC in each display gradation, and outputs the same to the display gradation conversion data generator 48 of the subsequent stage.

Figure 20:
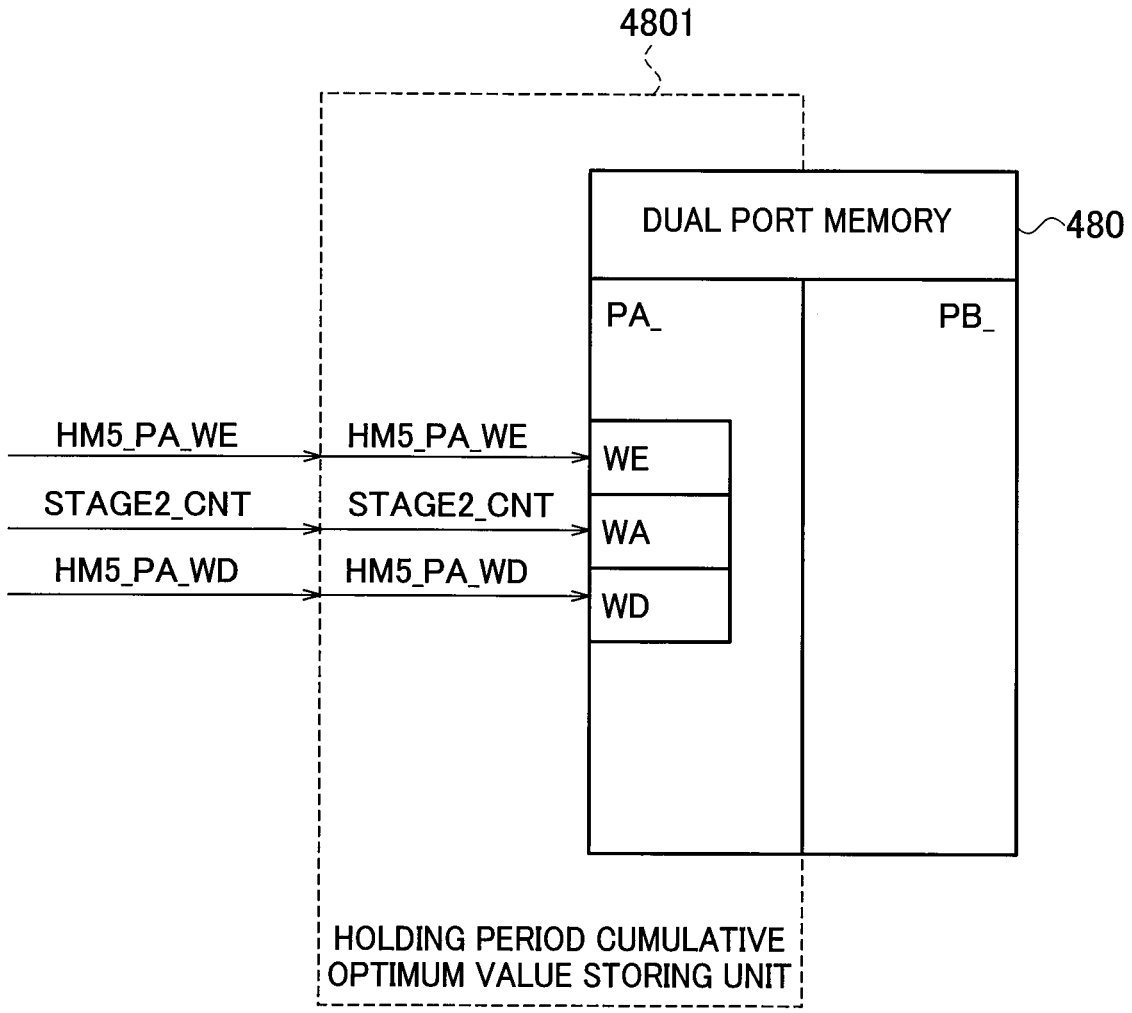
FIG. 20 is a block diagram showing an example of a holding period cumulative optimum value storing unit.
Figure 21A:
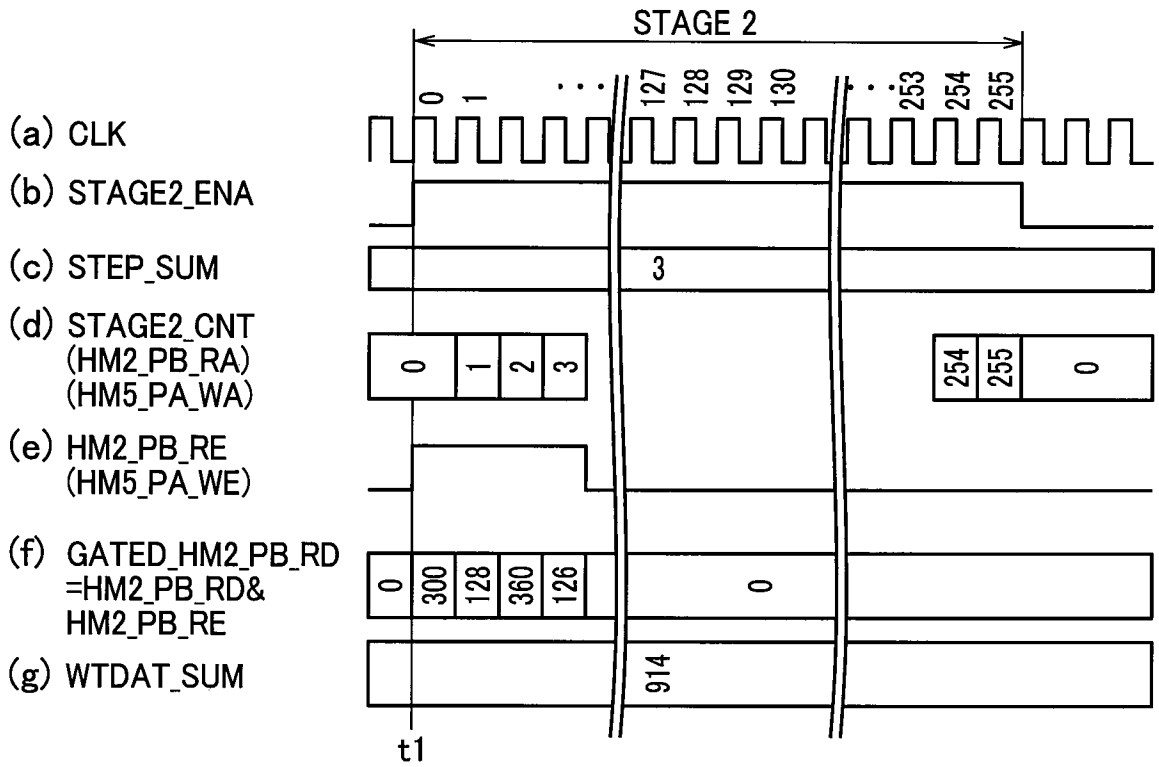
FIG. 21A is a time chart indicating a first example of various signals in the holding period optimum value generator and a display gradation conversion data generator.
Figure 21B:
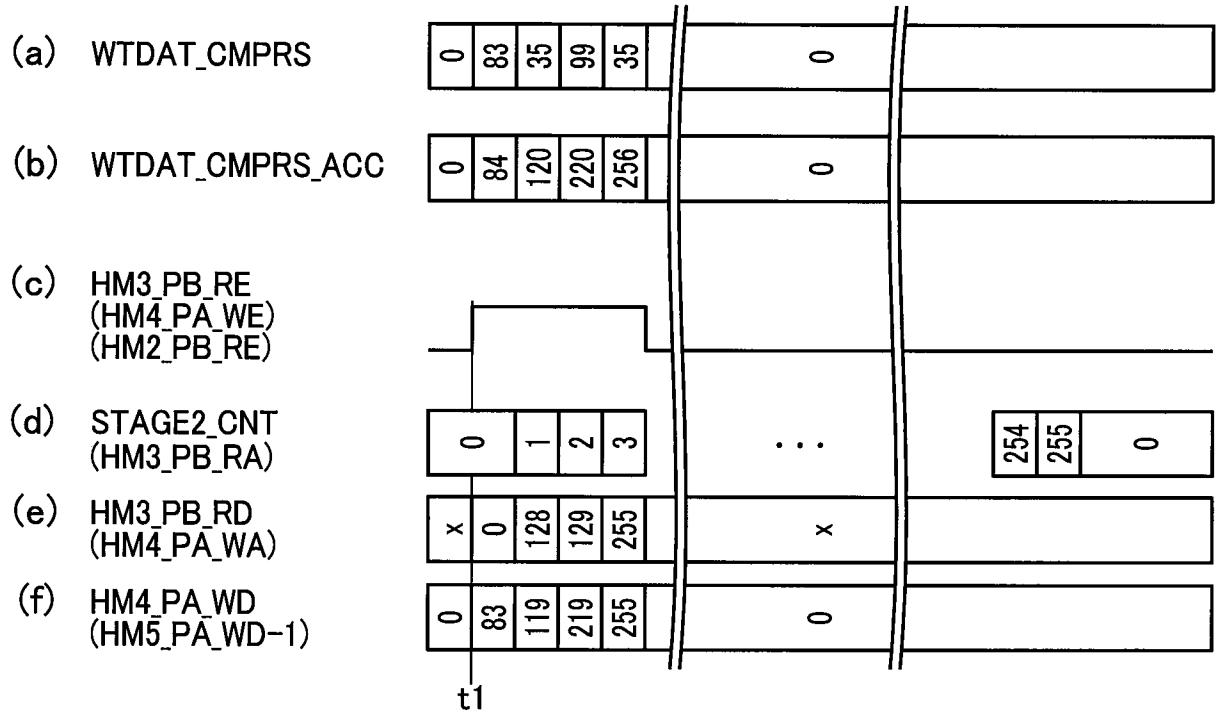
FIG. 21B is a time chart indicating a second example of various signals in the holding period optimum value generator and the display gradation conversion data generator.

The display gradation conversion data generator 48 includes the memory 483 shown in FIG. 20. The memory 483 is a dual port memory. The A port PA of the memory 480 is a holding period cumulative optimum value storing unit 4801. Data HM5_PA_WE (same as the logical product HM2_PB_RE), the count value STAGE2_CNT, and data HM5_PA_WD (holding period cumulative optimum value WTDAT_CMPRS_ACC) are input to the A port PA of the memory 480. The holding period cumulative optimum value storing unit 4801 writes the data HM5_PA_WD to the memory cells of the memory 480 by using the data HM5_PA_WE as enable and the count value STAGE2_CNT as an address.

The holding period cumulative optimum value WTDAT_CMPRS_ACC is input to the display gradation conversion data generator 48. The display gradation conversion data generator 48 converts the gradation value of the video data VDS into the holding period cumulative optimum value WTDAT_CMPRS_ACC, and outputs the result as the gradation-corrected video data SVDS to the horizontal scanning circuit 51 of the liquid crystal device 5.

Figure 22:
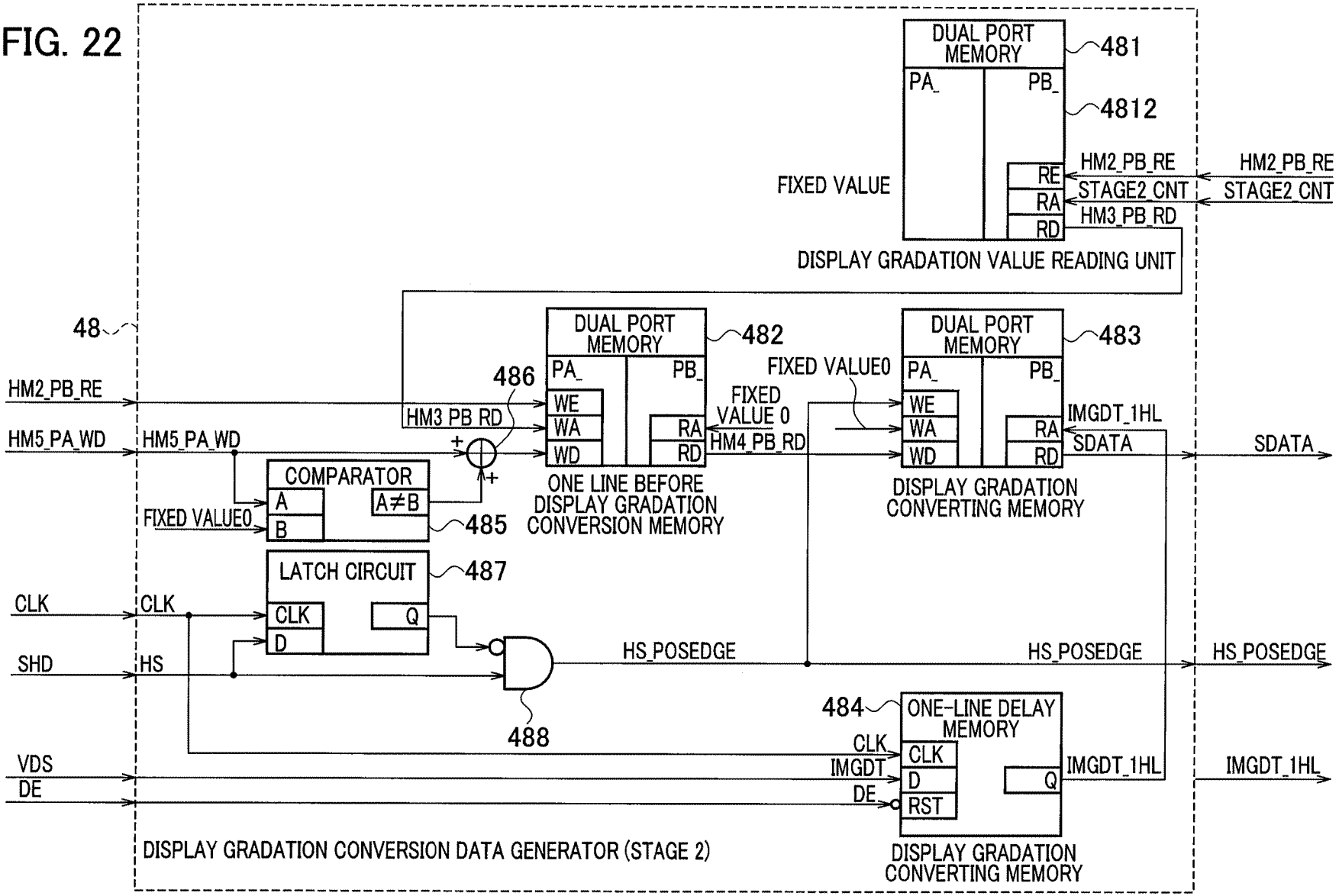
FIG. 22 is a block diagram showing an example of the display gradation conversion data generator.

FIG. 22 shows a configuration example of the display gradation conversion data generator 48. The display gradation conversion data generator 48 includes memories 481 to 484, a comparator 485, an adder 486, a latch circuit 487, and an AND circuit 488. The memories 481 to 483 are dual port memories.

The B port PB of the memory 481 is a display gradation value reading unit 4812. The display gradation value reading unit 4812 writes the display gradation value HM3_PB_RD to the memory cells of the memory 481 by using the logical product HM2_PB_RE as enable and the count value STAGE2_CNT as an address. The display gradation value reading unit 4812 reads the display gradation value HM3_PB_RD from the memory cells of the memory 481 and outputs the same to the A port PA of the memory 482.

The data HM5_PA_WD (same as the holding period cumulative optimum value WTDAT_CMPRS_ACC) is input to the A terminal of the comparator 485, and the fixed value 0 is input to B terminal thereof. The comparator 485 compares the data HM5_PA_WD with the fixed value 0, and outputs a low level output signal to the adder 486 when HM5_PA_WD=0, and outputs a high level output signal when HM5_PA_WD=0 is not satisfied. The adder 486 subtracts the output signal from the data HM5_PA_WD, and outputs the subtraction result to the A port PA of the memory 482.

The memory 482 is a one-line before display gradation conversion memory. The memory 482 writes the subtraction result output from the adder 486 to the memory cells by using the logical product HM2_PB_RE as enable and the display gradation value HM3_PB_RD as an address. The display gradation conversion data generator 48 stores the value at the end of the display gradation holding period of each display gradation for the display gradation value HM3_PB_RD in the A port PA of the memory 482.

The display gradation conversion data generator 48 updates the gradation conversion data for the video data VDS in units of one horizontal scanning period, and converts the video data VDS based on the gradation conversion data. However, such operation is performed during a period when the enable signal STAGE2_ENA is at the high level, and the timing when the enable signal STAGE2_ENA changes from the high level to the low level is different from the rising timing of the data enable signal DE. Therefore, in one or more embodiments, updating of the gradation conversion data is performed at the rising timing of the horizontal synchronization signal SHD that becomes the high level during the period when the data enable signal DE is at the low level. This operation will be described below.

The clock signal CLK and the horizontal synchronization signal SHD are input to the latch circuit 487. The latch circuit 487 is a one-clock delay element, for example. The latch circuit 487 delays the horizontal synchronization signal SHD by one clock, and outputs a bit-inverted signal thereof to the AND circuit 488.

The AND circuit 488 calculates a logical product HS_POSEDGE of the signal output from the latch circuit 487 and the horizontal synchronization signal SHD, and outputs the result to the A port PA of the memory 483. The logical product HS_POSEDGE is a signal that is at the high level for one clock width only at the rising timing of the horizontal synchronization signal SHD, and is at the low level otherwise.

The fixed value 0 is input to RA terminal of the B port PB of the memory 482 so that data of all the memory cells can be read at a time with one address, and a bit width of the read data is not 8-bit data width of the A port PA but the data width is 2048 bits with 8 bits×256 addresses. The memory 482 outputs the read data HM4_PB_RD to the A port PA of the memory 483.

The memories 483 and 484 are display gradation converting memories. The A port PA of the memory 483 has a data width of 2048 bits like the B port PB of the memory 482. The memory 483 writes the read data HM4_PB_RD to the memory cell in one clock by using the logical product HS_POSEDGE as enable and the fixed value 0 as an address. This write operation is completed in one clock from the rising timing of the horizontal synchronization signal SHD in a period when the data enable signal DE is at the low level (blanking period).

The memory 484 is a one-line delay memory, for example. The clock signal CLK, the video data VDS, and a bit-inverted signal of the data enable signal DE are input to the memory 484. The memory 484 is a line memory that outputs data obtained by delaying the data input to D terminal thereof by one reset cycle at the rising timing of a signal input to RST terminal thereof. Since the bit-inverted signal of the data enable signal DE is input to the RST terminal of the memory 484, the memory 484 generates video data IMGDT_1HL in which the video data VDS is delayed by one horizontal scanning period, and outputs the same to the B port PB of the memory 483. The memory 483 generates the gradation-corrected video data SVDS based on the video data IMGDT_1HL input to RA terminal thereof, and outputs the same to the liquid crystal device 5 of the subsequent stage.

The ramp waveform signal data generator 49 generates ramp waveform signal data VREF_DAT for outputting each gradation data in the order of low (for example, black level) or high (for example, white level) gradation direction and holding the gradation data according to the period of the holding period optimum value WTDAT_CMPRS, and outputs the same to the ramp waveform signal generating circuit 3 of the subsequent stage.

Figure 23A:
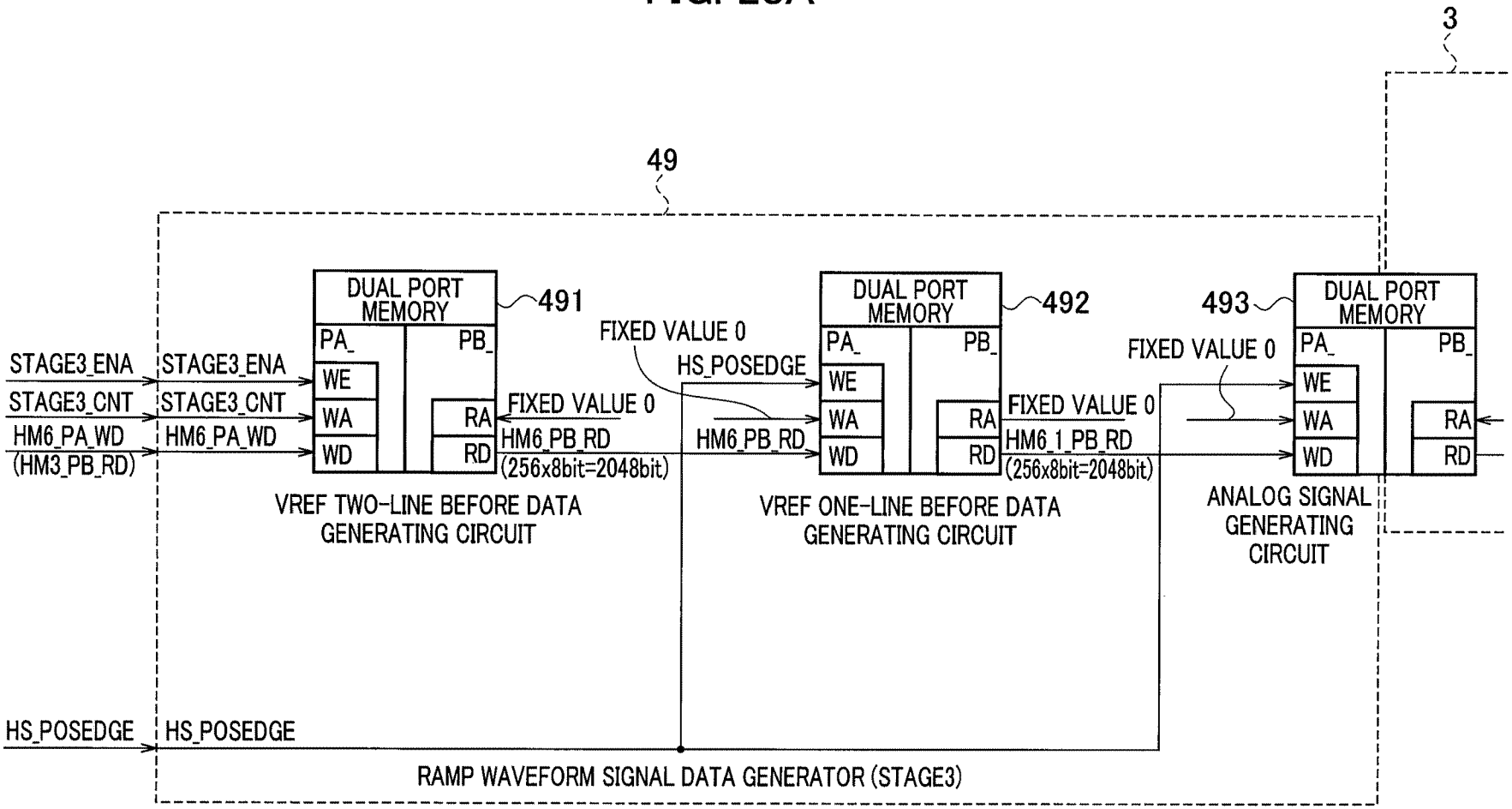
FIG. 23A is a block diagram showing an example of a ramp waveform signal data generator.
Figure 23B:
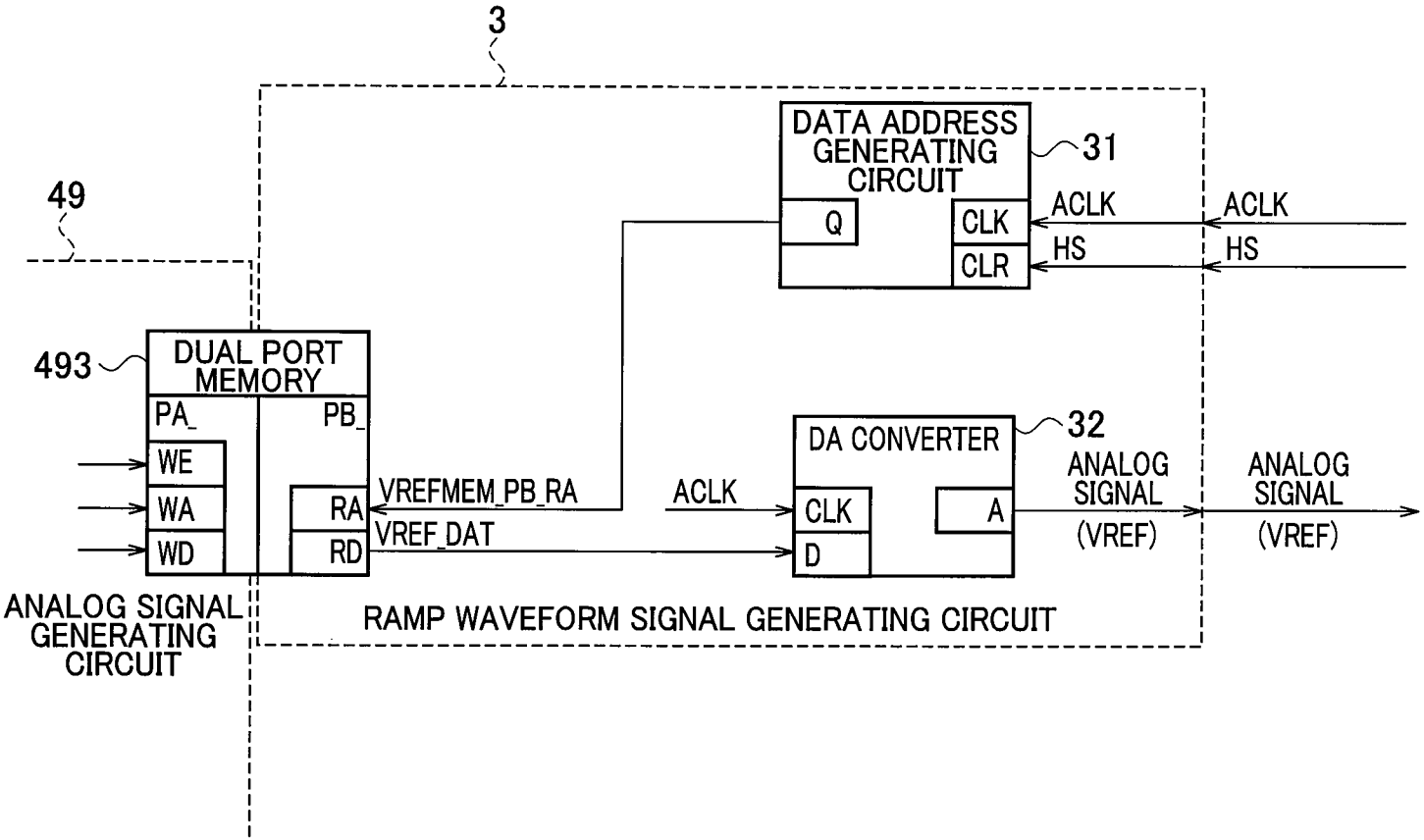
FIG. 23B is a block diagram showing an example of a ramp waveform signal generating circuit.
Figure 24:
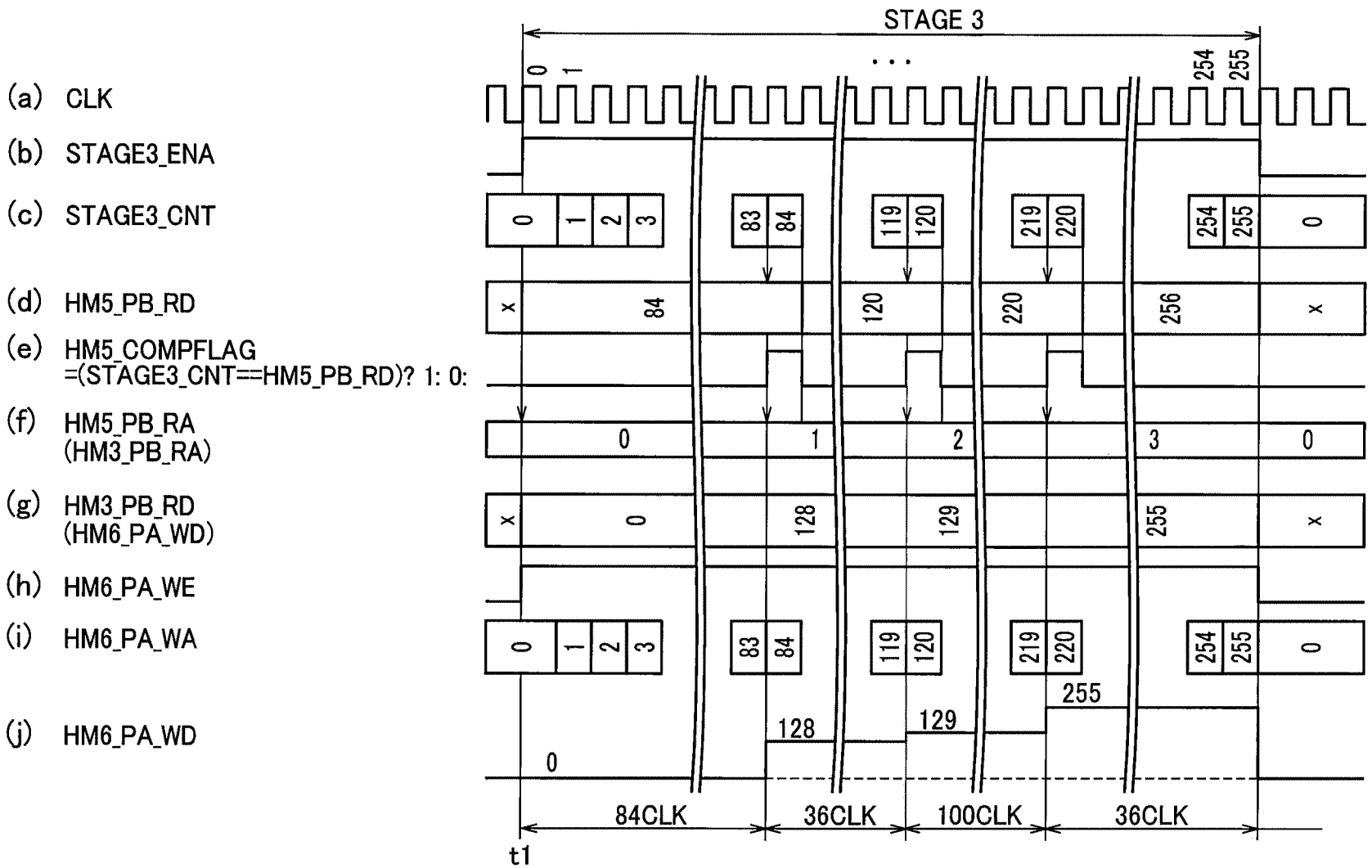
FIG. 24 is a time chart showing a first example of various signals in the ramp waveform signal data generator.

FIGS. 23A and 23B show configuration examples of the ramp waveform signal data generator 49 and the ramp waveform signal generating circuit 3 respectively. The ramp waveform signal data generator 49 includes memories 491 to 493. The memories 491 to 493 are dual port memories. Specifically, the ramp waveform signal data generator 49 includes the memory 491, the memory 492, and the A port PA of the memory 493. The memory 491 is a VREF two-line before data generating circuit for generating data of the ramp waveform signal VREF two lines before. The memory 492 is a VREF one-line before data generating circuit for generating data of the ramp waveform signal VREF one line before. The memory 493 is an analog signal generating circuit. FIG. 24 is a time chart showing an example of the relationship between the signals in the ramp waveform signal data generator 49.

Figure 25:
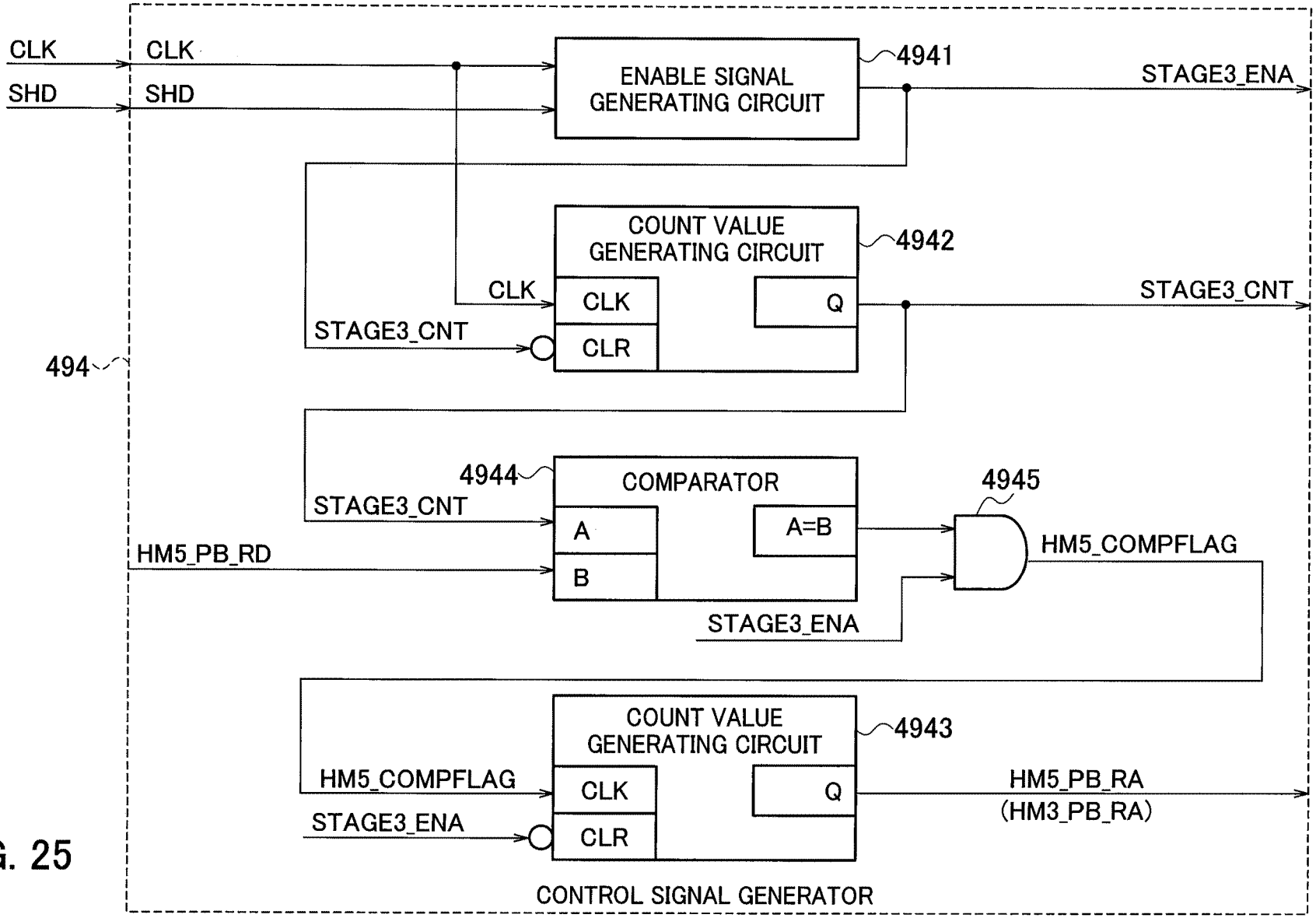
FIG. 25 is a block diagram showing an example of the control signal generator.
Figure 26:
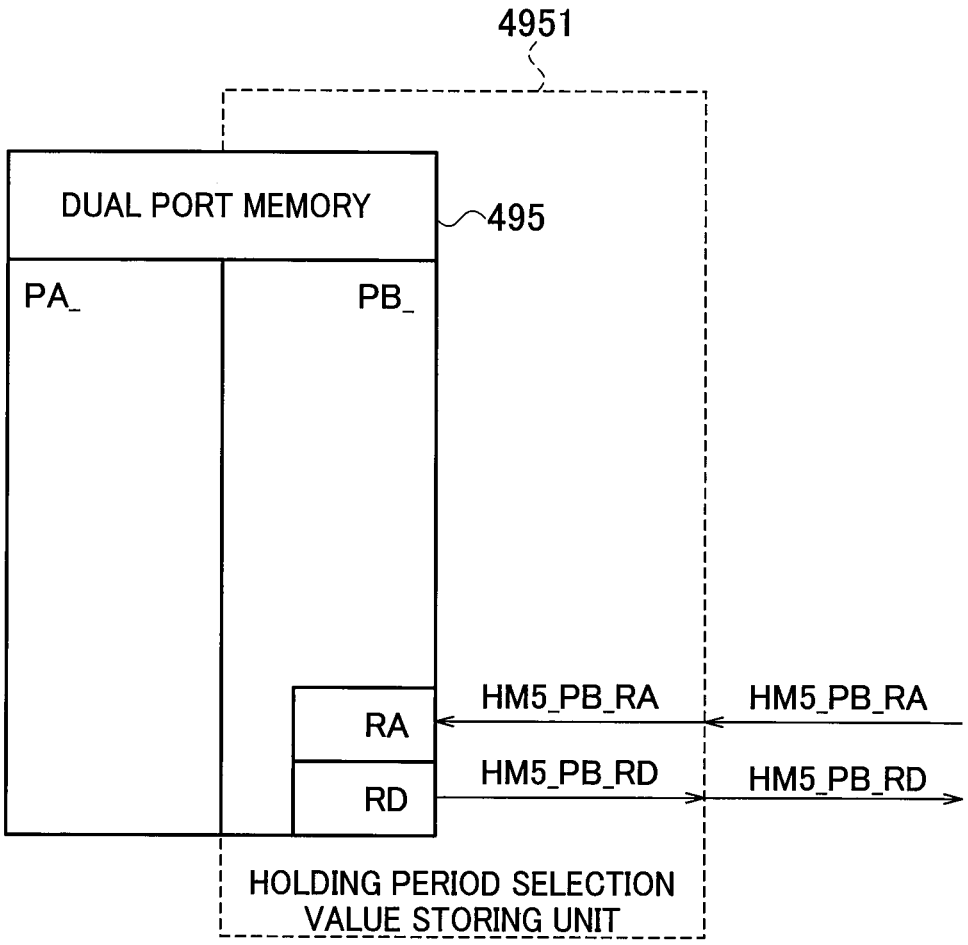
FIG. 26 is a block diagram showing an example of a holding period selection value storing unit.
Figure 27:
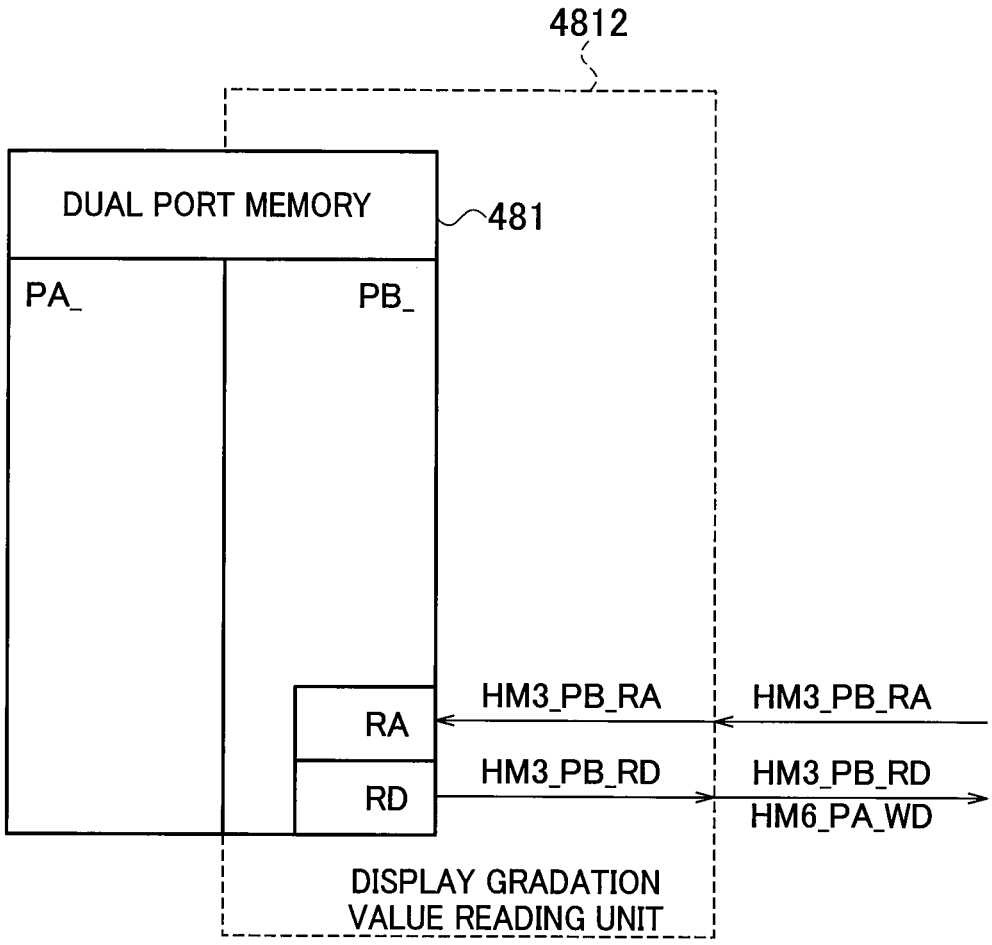
FIG. 27 is a block diagram showing an example of a display gradation value reading unit.

As shown in FIGS. 25 to 27, the ramp waveform signal data generator 49 includes a control signal generator 494, the B port PB of the memory 483, and the B port PB of the memory 481. The B port PB of the memory 481 is shared by the display gradation conversion data generator 48 and the ramp waveform signal data generator 49.

As shown in FIG. 25, the clock signal CLK and the horizontal synchronization signal SHD are input to the control signal generator 494. The control signal generator 494 includes an enable signal generating circuit 4941, count value generating circuits 4942 and 4943, a comparator 4944, and an AND circuit 4945. The enable signal generating circuit 4941 and the count value generating circuit 4942 and 4943 are counters.

The clock signal CLK and the horizontal synchronization signal SHD are input to the enable signal generating circuit 4941. The enable signal generating circuit 4941 generates an enable signal STAGE3_ENA based on the clock signal CLK and the horizontal synchronization signal SHD, and outputs the same to the A ports PA of the count value generating circuits 4942 and 4943, the AND circuit 4945, and the memory 491 of the subsequent stage.

The clock signal CLK and the enable signal STAGE3_ENA are input to the count value generating circuit 4942. The count value generating circuit 4942 generates a count value STAGE3_CNT (8 bits) that is 0 (count clear) when the enable signal STAGE3_ENA is at the low level, otherwise that is obtained by incrementing by one in synchronization with the rising edge of the clock signal CLK when the enable signal is at the high level, and outputs the same to the comparator 4944 and the A port PA of the memory 491 of the subsequent stage.

As shown in FIG. 26, the B port PB of the memory 495 is the holding period selection value storing unit 4951. The memory 483 reads read data HM5_PB_RD stored in the memory cell thereof by using a count value HM5_PB_RA as an address, and outputs the same to the comparator 4944. The count value STAGE3_CNT is input to the A terminal of the comparator 4944, and the read data HM5_PB_RD is input to the B terminal thereof. The comparator 4944 compares the count value STAGE3_CNT with the read data HM5_PB_RD, outputs the high level output signal when the count value STAGE3_CNT matches the read data HM5_PB_RD, and outputs the low level output signal to the AND circuit 4945 otherwise.

The AND circuit 4945 calculates a logical product HM5_COMPFLAG of the output signal of the comparator 4944 and the enable signal STAGE3_ENA, and outputs the result to the count value generating circuit 4943. The logical product HM5_COMPFLAG and the enable signal STAGE3_ENA are input to the count value generating circuit 4943.

The count value generating circuit 4943 outputs, to the B port PB of the memory 483, the count values HM5_PB_RA and HM3_PB_PA, which are 0 when the enable signal STAGE3_ENA is at the low level, and otherwise count up by one at the rising edge of the logical product HM5_COMPFLAG.

As shown in FIG. 27, the count value HM3_PB_RA is input to the B port PB of the memory 481. The memory 481 outputs the display gradation value HM3_PB_RD to the memory 482 by using the count value HM3_PB_RA as an address.

As shown in FIG. 23A, the enable signal STAGE3_ENA, the count value STAGE3_CNT, and write data HM6_PA_WD (same as the display gradation value HM3_PB_RD) are input to the A port PA of the memory 491. The memory 491 writes the write data HM6_PA_WD to the memory cells by using the enable signal STAGE3_ENA as enable and the count value STAGE3_CNT as an address.

The write data HM6_PA_WD is written to the A port PA of the memory 491 while the enable signal STAGE3_ENA is at the high level. The timing when the enable signal STAGE3_ENA changes from the high level to the low level is different from the rising timing of the data enable signal DE. The ramp waveform signal data generator 49 updates the ramp waveform signal VREF at the falling timing of the horizontal synchronization signal SHD that becomes high level while the data enable signal DE is low level. This operation will be described below.

To RA terminal of the B port PB of the memory 491, the fixed value 0 is input so that data of all the memory cells can be read at a time with one address, and a bit width of the read data is not 8-bit data width of the A port PA but the data width is 2048 bits with 8 bits×256 addresses. The memory 491 outputs the read data HM6_PB_RD to the A port PA of the memory 492.

The A port PA of the memory 492 has a data width of 2048 bits like the B port PB of the memory 491. The A port PA of the memory 492 writes the read data HM6_PB_RD to the memory cells in one clock by using the logical product HS_POSEDGE as enable and the fixed value 0 as an address. The B port PB of the memory 492 reads the 2048-bit read data HM6_PB_RD from which all the memory cells data can be read with one address, in the same manner as the B port PB of the memory 491, by using the fixed value 0 as an address, and outputs the same to the A port PA of the memory 493.

The A port PA of the memory 493 writes the read data HM6_PB_RD to the memory cells in one clock by using the logical product HS_POSEDGE as enable and the fixed value 0 as an address.

As shown in FIG. 23B, the ramp waveform signal generating circuit 3 includes the B port PB of the memory 493, a data address generating circuit 31, and a DA converter 32. The data address generating circuit 31 receives the gradation counter clock signal ACLK and the horizontal synchronization signal SHD. The data address generating circuit 31 generates a count value VREFMEM_PB_RA that is 0 (count clear) when the horizontal synchronization signal SHD is at the high level, otherwise that is obtained by incrementing by one in synchronization with the rising edge of the gradation counter clock signal ACLK, and outputs the same to the B port PB of the memory 493.

The memory 493 generates the ramp waveform signal data VREF_DAT by using the count value VREFMEM_PB_RA as an address, and outputs the same to the DA converter 32. Specifically, the memory 493 generates the ramp waveform signal data VREF_DAT for holding the gradation data according to the period of the holding period optimum value WTDAT_CMPRS, and outputs the same to the DA converter 32.

The DA converter 32 receives the gradation counter clock signal ACLK and the ramp waveform signal data VREF_DAT. The DA converter 32 performs D/A (digital/analog) conversion of the ramp waveform signal data VREF_DAT, which is a digital signal, into the ramp waveform signal VREF, which is an analog signal, in synchronization with the gradation counter clock signal ACLK, and outputs the result to the selection circuits 65 (from 651 to 65*x*) of the liquid crystal device 5. The ramp waveform signal VRE is converted to an analog voltage of 0 V when the gradation data of the ramp waveform signal data VREF_DAT is 0, and converted to an analog voltage of 2.55 V when the gradation data is 255.

Figure 28:
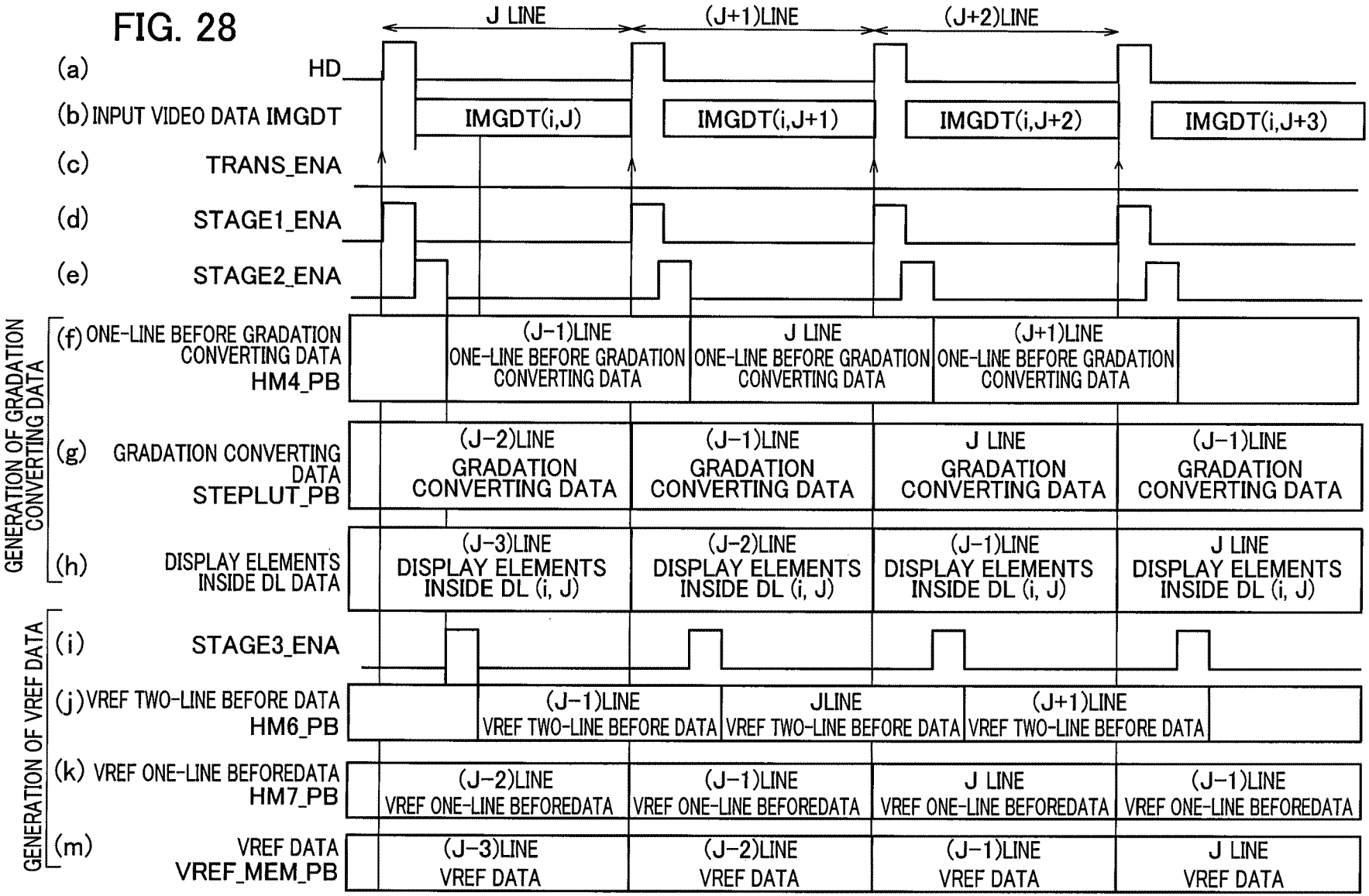
FIG. 28 is a time chart showing an example of various signals in a liquid crystal device.

An operation of the liquid crystal device 5 will be described with reference to FIG. 1 and FIGS. 28 to 35. FIG. 28 is a time chart showing an example of a relationship between the various signals in the liquid crystal device 5.

The liquid crystal device 5 takes in the gradation-corrected video data SVDS sequentially input from the signal processing device 4 into the shift register 61 of the horizontal scanning circuit 51. The latch circuit 62 takes in the gradation data DL corresponding to the number of gradations of the pixels 53 in one horizontal direction at the rising edge of the latch pulse signal SL that becomes high only once during one horizontal scanning period. After clearing the comparator circuit 64 (641 to 64*x*) based on the counter reset signal CRST synchronized with the latch pulse signal SL, the counter circuit 63 counts the counter clock signal CCLK, generates the gradation counter value QD, and outputs the same to the comparator circuits 64 (641 to 64*x*).

Each comparator circuit 64 (641 to 64*x*) compares the gradation data DL with the gradation counter value QD, generates a coincidence pulse signal AP when the gradation data DL and the gradation counter value QD match and outputs the same to the corresponding selection circuit 65 (from 651 to 65*x*). The all-pixel reset signal SELRST from the timing generating circuit 2, the coincidence pulse signal AP from the corresponding comparator circuit 64 (641 to 64*x*), and the ramp waveform signal VREF from the ramp waveform signal generating circuit 3 are input to the selection circuits 65 (651 to 65*x*).

The comparator circuits 64 (641 to 64*x*) switch the ramp waveform signal VREF to the gradation drive voltage VID at the rising timing of the all-pixel reset signal SELRST, and stop the output by switching off at the falling timing of the all-pixel reset signal SELRST.

The timing of the coincidence pulse signal AP, which is generated when the video data VDS matches the gradation data converted to the holding period optimum value WTDAT_CMPRS in the display gradation converting data generator 48, matches the timing of the ramp waveform signal VREF based on the holding period optimum value WTDAT_CMPRS. In accordance with the signal processing device, the signal processing method, and the liquid crystal display device according to one or more embodiments, because of the end of settling period by the ringing of the ramp waveform signal VREF held based on the holding period optimum value WTDAT_CMPRS, or because of the end of the selection of the selection circuit 65 at the timing at which the voltage amplitude based on the voltage slew rate converges to an allowable level, it is possible to display an image in which the display gradation error due to ringing or the voltage slew rate is suppressed.

Figure 29:
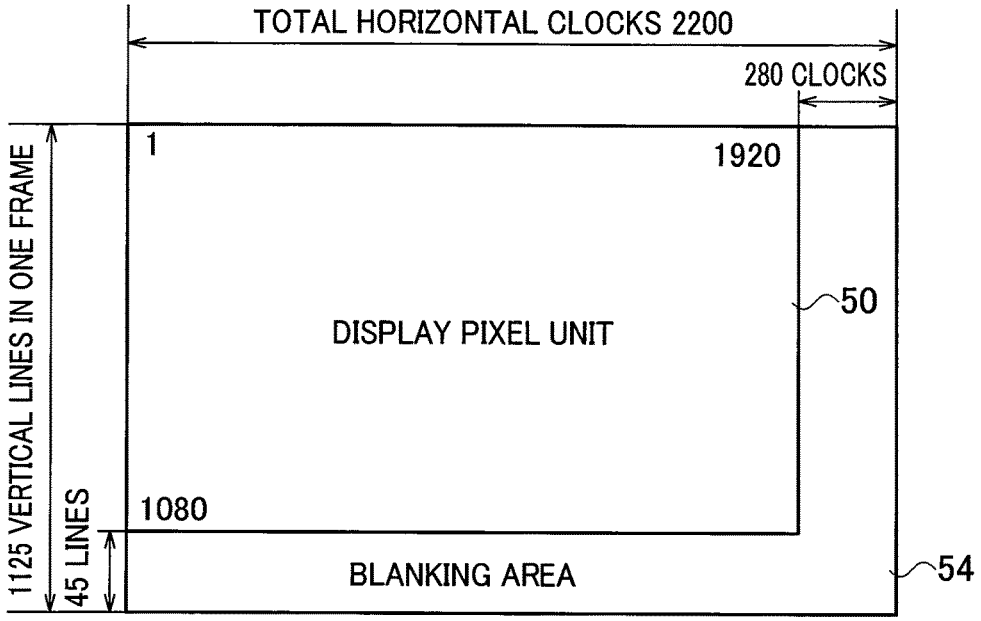
FIG. 29 is a diagram showing an example of a concept of a format of the video data.

FIG. 29 shows an example of a concept of a format of the video data VDS sequentially input to the signal processing device 4 in synchronization with the clock signal CLK. FIG. 29 shows a state that, in the format of the video data VDS, the total number of clocks in the horizontal direction is 2200, the number of lines in the vertical direction is 1125, the number of pixels in the horizontal direction in the display pixel unit 50 is 1920 and the number of lines in the vertical direction thereof is 1080, and the blanking area 54 exists in the region other than the region of the display pixel unit 50. That is, in the display pixel unit 50, the pixels 53 are arranged in a matrix of 1920 columns (x=1920)×1080 rows (y=1080).

The data enable signal DE is at the high level in the display pixel unit 50 and is at the low level in the blanking area 54. The horizontal synchronization signal SHD is set to the low level in the display pixel unit 50 (the range of the 1-st to 1920-th pixels 53 in the horizontal direction) and to the high level in the blanking area 54. The vertical synchronization signal SVD is set to the low level in the display pixel unit 50 (the range of the 1-st to 1080-th lines in the vertical direction) and to the high level in the blanking area 54. The blanking period is the period in which the horizontal synchronization signal SHD and the vertical synchronization signal SVD are at the high level. The display gradation is set to 0 to 255 gradations (8 bits).

Figure 30:
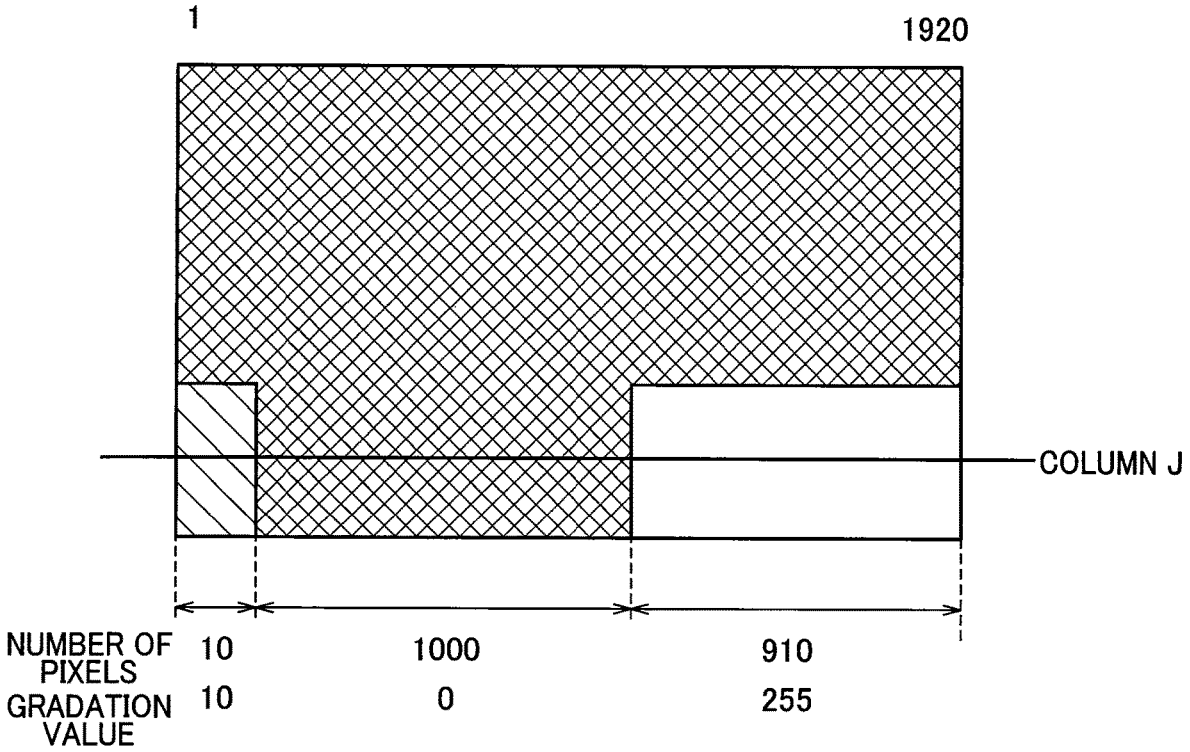
FIG. 30 is a diagram showing an example of a display image of the video data.

FIG. 30 shows an example of a display image of the video data VDS. FIG. 30 shows a state that, in the J-th row (1≤J≤y) of the display pixel unit 50, the number of gradations of the pixels 53 in 10 columns from the 1-st column to 10-th column is 10, and the number of gradations of the pixels 53 in 1000 columns from the 11-th column to 1010-th column is 0, and the number of gradations of the pixels 53 in 910 columns from the 1011-th column to 1920-th column is 255. The J-th row corresponds to the J-th line.

Figure 31:
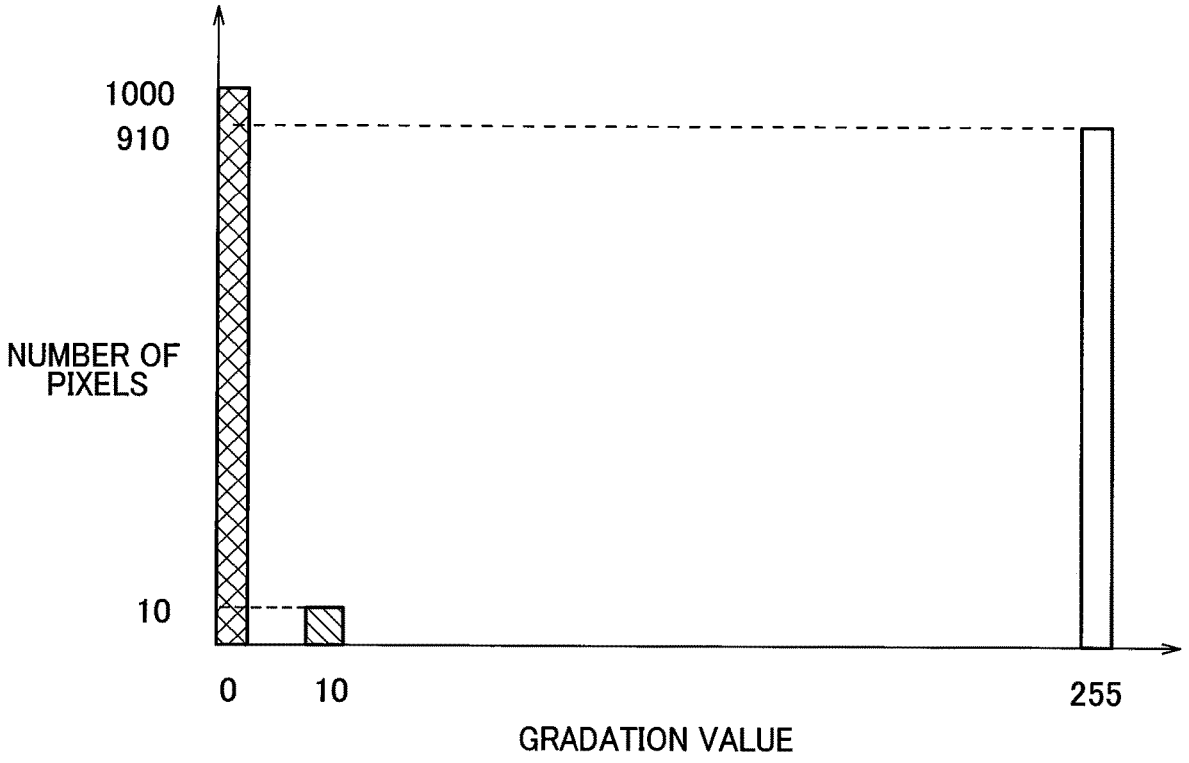
FIG. 31 is a diagram showing an example of a display target gradation histogram.

FIG. 31 shows an example of a gradation histogram NDP generated by the gradation histogram generator 41 of the signal processing device 4 based on the video data VDS. The vertical axis indicates the number of pixels, and the horizontal axis indicates the gradation value. In the gradation histogram NDP shown in FIG. 31, because there are three gradation values (0, 10, and 255), the ramp waveform signal generating circuit 3 generates the ramp waveform signal VREF having three analog voltages (for example, 0 V, 0.1 V, and 2.55 V).

When the gradation value changes from 0 to 10, because the change in the gradation value is small, the first display gradation holding period value WTDAT_SLW corresponding to the settling period (corresponding to the number of clocks) in which the slew rate is stabilized is small. However, because the number of pixels (1000) with the gradation value of 0 is larger than the number of pixels (10) with the gradation value of 10, the ringing that occurs when sampling of the pixel 53 with the gradation value of 0 is turned off is large. Therefore, the second display gradation holding period value WTDAT_STP corresponding to the settling period (corresponding to the number of clocks) in which ringing is stable is large. That is, the first display gradation holding period value WTDAT_SLW and the second display gradation holding period value WTDAT_STP satisfy the relationship WTDAT_SLW<WTDAT_STP.

Therefore, when the change in the gradation value is small and the number of pixels of the gradation at which the sampling is turned off is large, the holding period provisional value generator 45 of the signal processing device 4 selects the second display gradation holding period value WTDAT_STP.

When the gradation value changes from 10 to 255, because this change in the gradation value is large, the first display gradation holding period value WTDAT_SLW is large. However, because the number of pixels (10) with the gradation value of 10 is smaller than the number of pixels (910) with the gradation value of 255, ringing that occurs when sampling of the pixel 53 with the gradation value of 10 is turned off is small. Therefore, the second display gradation holding period value WTDAT_STP is small. That is, the first display gradation holding period value WTDAT_SLW and the second display gradation holding period value WTDAT_STP satisfy the relationship WTDAT_SLW>WTDAT_STP.

Therefore, when the change of the gradation value is large and the number of pixels of the gradation at which the sampling is turned off is small, the holding period provisional value generator 45 of the signal processing device 4 selects the first display gradation holding period value WTDAT_SLW.

Figure 32:
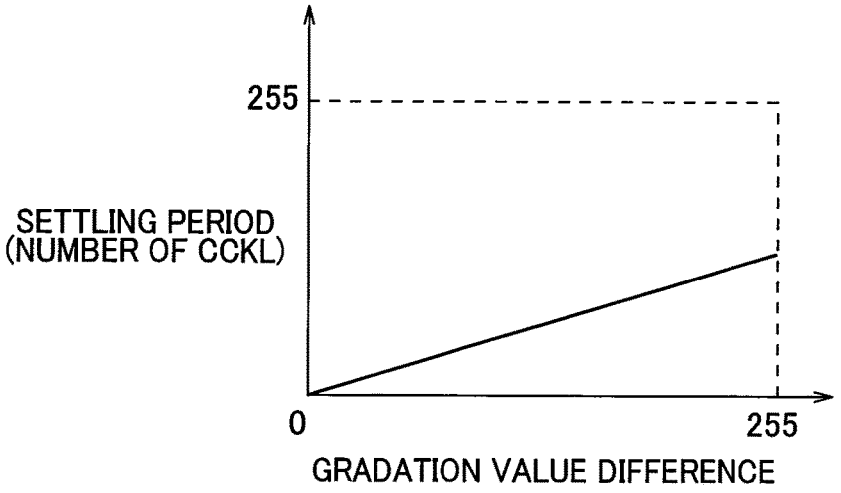
FIG. 32 is a diagram illustrating an example of a relationship between a change in a gradation value and a first display gradation holding period value.
Figure 33:
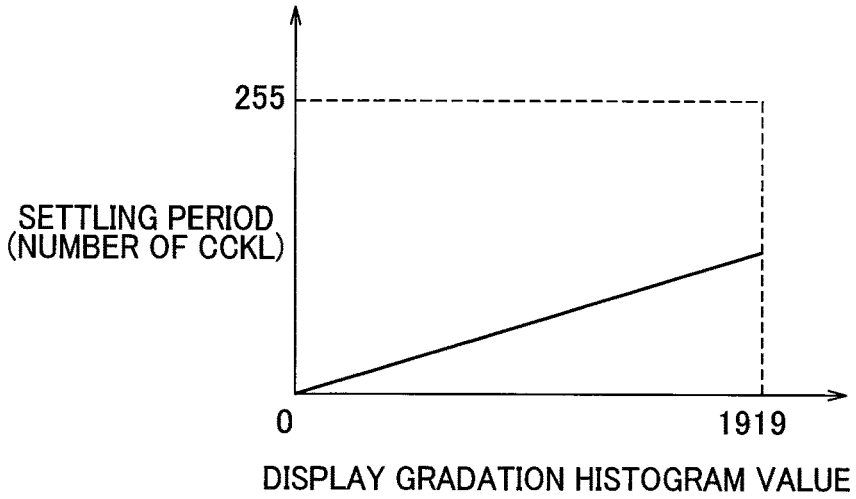
FIG. 33 is a diagram illustrating an example of a relationship between the display target gradation histogram value and a second display gradation holding period value.

FIG. 32 shows an example of the relationship between the change in the gradation value (the gradation value difference STEP_DIF) and the first display gradation holding period value WTDAT_SLW. The vertical axis of FIG. 32 shows the first display gradation holding period value WTDAT_SLW in terms of the settling period (the number of clocks), and the horizontal axis shows the gradation value difference STEP_DIF. FIG. 33 shows an example of a relationship between the gradation histogram value HV and the second display gradation holding period value WTDAT_STP. The vertical axis of FIG. 33 indicates the second display gradation holding period value WTDAT_STP in terms of the settling period (the number of clocks), and the horizontal axis indicates the gradation histogram value HV by the number of pixels.

The signal processing device 4 may prepare a graph or a data table depicting the relationship between the change in display gradation and the first display gradation holding period value WTDAT_SLW shown in FIG. 32, and the gradation histogram HV and second display gradation holding period value WTDAT_STP shown in FIG. 33, and store the same in a storing unit or the like. The holding period provisional value generator 45 reads this graph or the data table from the storing unit and selects the first display gradation holding period value WTDAT_SLW or the second display gradation holding period value WTDAT_STP based on the read graph or the data table.

The holding period total value generator 46 generates the holding period total value WTDAT_SUM that is the sum of the holding period provisional value WTDAT_SEL during one horizontal scanning period. Because the holding period total value WTDAT_SUM does not match the number of clocks (256), the holding period total value generator 46 optimizes the holding period total value WTDAT_SUM so as to be equal to or less than the number of clocks. For example, the holding period total value generator 46 compares the holding period total value WTDAT_SUM with the number of clocks, and adjusts the holding period total value WTDAT_SUM based on the comparison result (ratio).

Figure 34:
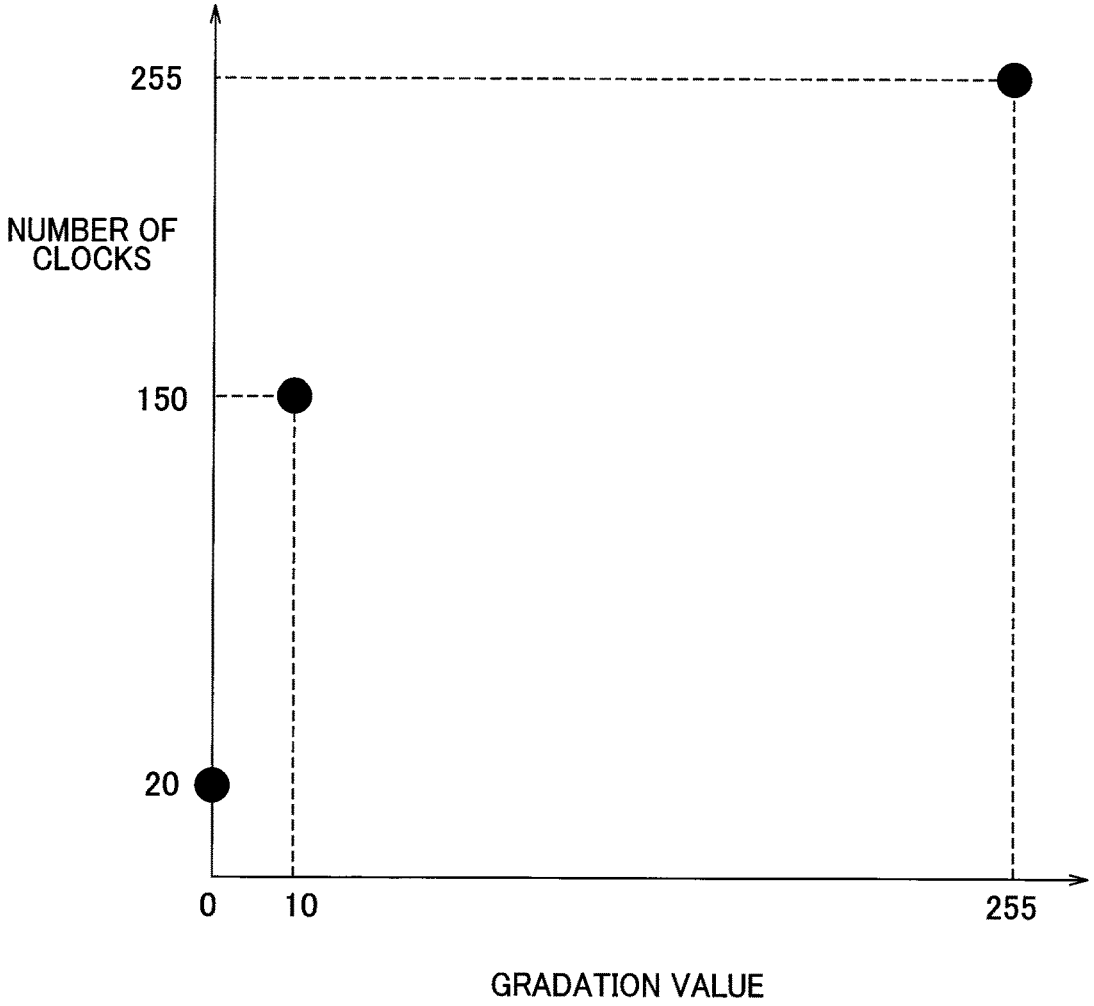
FIG. 34 is a diagram showing an example of a relationship between a display gradation and a timing when sampling is turned off.

FIG. 34 shows an example of a relationship between the display gradation and the timing at which the sampling is turned off. The vertical axis of FIG. 34 indicates the number of clocks of the timing at which the sampling is turned off, and the vertical axis indicates the gradation value. The sampling when the gradation value is 0 is turned off at the 20-th clock. The sampling when the gradation value is 10 is turned off at the 150-th clock. The sampling when the gradation value is 255 is turned off at the 255-th clock.

The signal processing device 4 may prepare a graph or a data table depicting the relationship between the display gradation shown in FIG. 34 and the timing at which the sampling is turned off, and store the graph or the data table in a storing unit or the like. The holding period total value generator 46 reads this graph or the data table from the storing unit, and adjusts the holding period total value WTDAT_SUM based on the read table or data table.

Figure 35:
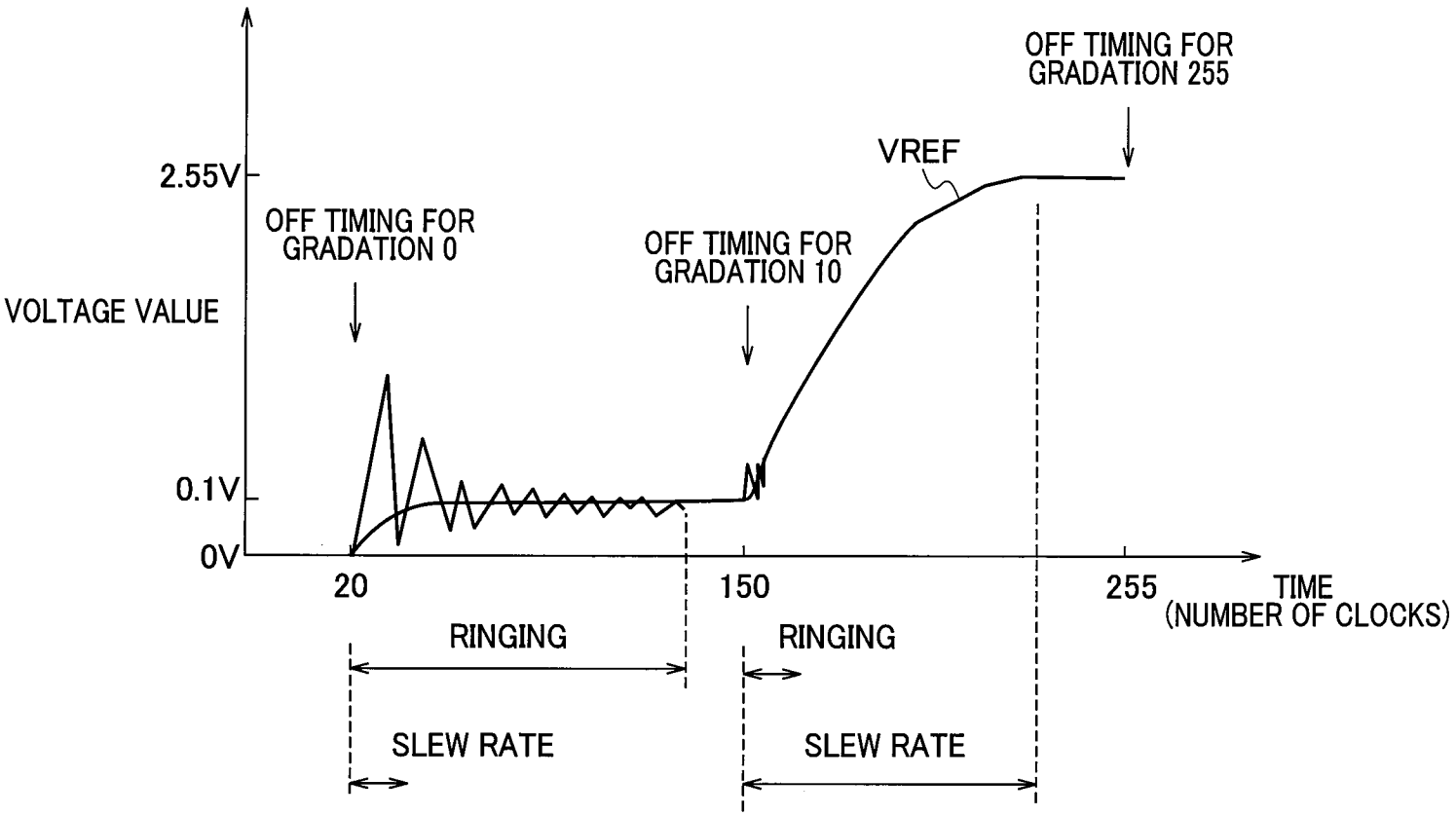
FIG. 35 is a diagram illustrating an example of a ramp waveform signal VREF output from the ramp waveform signal generating circuit 3.

FIG. 35 shows an example of the ramp waveform signal VREF output by the ramp waveform signal generating circuit 3 analog converting the ramp waveform signal data VREF_DAT into the ramp waveform signal VREF. The vertical axis indicates the voltage value of the ramp waveform signal VREF, and the horizontal axis indicates time in clocks. It is assumed that the voltage value of the ramp waveform signal VREF changes by 0.01 V every one display gradation.

Up to the 20-th clock, the voltage value of the ramp waveform signal VREF is 0 V corresponding to the gradation value 0. At the 21-st clock, all 1000 pixels 53 having the gradation value of 0 are turned off at once. The ramp waveform signal VREF becomes 0.1 V corresponding to the gradation value 10. However, because all the 1000 pixels 53 are turned off at once, ringing occurs at a large number of clocks. Accordingly, in FIG. 35, the timing at which the sampling is turned off is set to the 150-th clock, and sampling is performed at a stable voltage of 0.1 V.

On the other hand, because the voltage changes greatly from 0.1 V to 2.55 V at the next gradation value 255, the number of clocks at the slew rate increases, and the ringing that is turned off at the gradation value 10 immediately stops. Because the sampling is turned off at the 255-th clock after the 150-th clock, the sampling can be performed at a stable voltage of 2.55 V.

In accordance with the signal processing device, the signal processing method, and the liquid crystal display device according to one or more embodiments, by changing the voltage value of the ramp waveform signal VREF and the timing of turning off the sampling dynamically and row by row, it is possible to suppress the occurrence of ringing of the analog ramp waveform and to improve the gradation reproducibility of the liquid crystal device as compared with the prior art.

In the signal processing device, the signal processing method, and the liquid crystal display device according to one or more embodiments, a settling period (switching noise settling period) based on the switching noise of the analog switch based on the gradation histogram value that is each display gradation number on one horizontal line and a settling period based on the slew rate (slew rate settling period) generated in the analog ramp waveform having a stepped shape due to the gradation value difference STEP_DIF are compared.

In accordance with the signal processing device, the signal processing method, and the liquid crystal display device according to one or more embodiments, of these settling periods, an analog ramp waveform having a holding period for selecting a larger settling period and holding each display target gradation, and by performing display gradation conversion, which converts the analog counter into a gradation value corresponding to a gradation counter value at which a analog switch is turned off immediately before the end of the holding period, a high-quality display image in which gradation deterioration is suppressed can be displayed.

Therefore, in accordance with the signal processing device, the signal processing method, and the liquid crystal display device according to one or more embodiments, by suppressing the occurrence of ringing of the analog ramp waveform, the gradation reproducibility of the liquid crystal device is improved as compared with the prior art.

The present invention is not limited to the above-described one or more embodiments, and can be modified in various manner without departing from the scope of the present invention.

What is claimed is:

1. A signal processing device comprising:

a gradation histogram generator configured to generate a gradation histogram indicating the number of pixels for each display gradation of input video data during each horizontal scanning period;

a display gradation number acquisition unit configured to acquire the number of display gradations of the video data during each horizontal scanning period based on the gradation histogram;

a first display gradation holding period value generator configured to generate a first display gradation holding period value based on a gradation value difference, the first display gradation holding period value being a display gradation holding period value indicating a period for holding a display gradation determined based on the gradation value difference between two adjacent display gradations in each horizontal scanning period and a voltage slew rate of a ramp waveform signal;

a second display gradation holding period value generator configured to generate a second display gradation holding period value based on the number of pixels for each display gradation, the second display gradation holding period value being a display gradation holding period value indicating a period for holding a display gradation based on a settling period in which ringing of the ramp waveform signal generated at a timing when a voltage value of the ramp waveform signal changes according to the number of display gradations attenuates to a level that does not affect a displayed image by the input video data;

a holding period provisional value generator configured to compare the first display gradation holding period value and the second display gradation holding period value, and to select a display gradation holding period value having a larger value between the first display gradation holding period value and the second display gradation holding period value to generate a holding period provisional value;

a holding period total value generator configured to generate a holding period total value that is a sum of the holding period provisional value during each horizontal scanning period;

a holding period optimum value generator configured to generate a holding period optimum value of each display gradation, based on a display target gradation number, which is the number of gradations to be displayed during each horizontal scanning period, and the holding period provisional value;

a ramp waveform signal data generator configured to generate ramp waveform signal data that holds gradation data for generating the ramp waveform signal based on the holding period optimum value.

2. The signal processing device according to claim 1, further comprising a display gradation converting data generator configured to correct a gradation of the video data for each horizontal scanning period based on the holding period optimum value, and to generate gradation-corrected video data.

3. A liquid crystal display device comprising:

the signal processing device as claimed in claim 2;

a ramp waveform signal generating circuit configured to analog convert the ramp waveform signal data to generate the ramp waveform signal; and a liquid crystal device having a plurality of pixels and configured to generate a gradation drive voltage for each of the pixels based on the gradation-corrected video data and the ramp waveform signal.

4. A signal processing method comprising:

generating a gradation histogram indicating the number of pixels for each display gradation of input video data during each horizontal scanning period;

acquiring the number of display gradations of the video data during each horizontal scanning period based on the gradation histogram;

generating a first display gradation holding period value based on a gradation value difference, the first display gradation holding period value being a display gradation holding period value indicating a period for holding a display gradation determined based on the gradation value difference between two adjacent display gradations in each horizontal scanning period and a voltage slew rate of a ramp waveform signal;

generating a second display gradation holding period value based on the number of pixels for each display gradation, the second display gradation holding period value being a display gradation holding period value indicating a period for holding a display gradation based on a settling period in which ringing of the ramp waveform signal generated at a timing when a voltage value of the ramp waveform signal changes according to the number of display gradations attenuates to a level that does not affect a displayed image by the input video data;

comparing the first display gradation holding period value and the second display gradation holding period value;

selecting a display gradation holding period value having a larger value between the first display gradation holding period value and the second display gradation holding period value to generate a holding period provisional value;

generating a holding period total value that is a sum of the holding period provisional value during each horizontal scanning period;

generating a holding period optimum value of each display gradation, based on a display target gradation number, which is the number of gradations to be displayed during each horizontal scanning period, and the holding period provisional value;

generating ramp waveform signal data that holds gradation data for generating the ramp waveform signal based on the holding period optimum value.

* * * * *